US009463942B2

(12) United States Patent
Yanez, Jr. et al.

(10) Patent No.: US 9,463,942 B2
(45) Date of Patent: Oct. 11, 2016

(54) APPARATUS FOR POSITIONING AN ADVANCING WEB

(71) Applicant: The Procter & Gamble Company, Cincinnati, OH (US)

(72) Inventors: Ricky Reynaldo Yanez, Jr., Cincinnati, OH (US); Todd Douglas Lenser, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 375 days.

(21) Appl. No.: 14/034,593

(22) Filed: Sep. 24, 2013

(65) Prior Publication Data

US 2015/0083848 A1 Mar. 26, 2015

(51) Int. Cl.
*B65H 23/032* (2006.01)
*B65H 23/02* (2006.01)

(52) U.S. Cl.
CPC ..... *B65H 23/032* (2013.01); *B65H 23/0204* (2013.01); *B65H 2301/211* (2013.01); *B65H 2301/3611* (2013.01); *B65H 2301/3613* (2013.01); *B65H 2403/55* (2013.01); *B65H 2404/66* (2013.01); *B65H 2555/20* (2013.01); *B65H 2801/57* (2013.01)

(58) Field of Classification Search
CPC B65H 23/032; B65H 23/035; B65H 23/038; B65H 23/0204; B65H 2555/20; B65H 2403/55; B65H 2301/3611; B65H 2301/3613; B65H 2301/36132; B65H 2404/66
See application file for complete search history.

(56) References Cited

U.S. PATENT DOCUMENTS 231,145 A 8/1880 Brady
916,702 A 3/1909 Hartt
1,746,544 A 2/1930 Malm
2,660,088 A 11/1953 Vinto
3,304,791 A 2/1967 Robert
3,436,002 A 4/1969 Racine
3,728,191 A 4/1973 Wierzba
3,963,557 A 6/1976 Patterson (Continued)

FOREIGN PATENT DOCUMENTS

DE 33 23 919 7/1983
EP 0 997 123 5/2000

(Continued)

OTHER PUBLICATIONS

PCT International Search Report dated Dec. 17, 2014, 10 pages.

*Primary Examiner* — Michael McCullough
(74) *Attorney, Agent, or Firm* — Sarah M. DeCristofaro; Abbey A. Lopez

(57) ABSTRACT

An apparatus may be used to control the cross-directional movement of a web advancing in a machine direction. The web defines a machine direction centerline. The apparatus may include a frame rotatable about a first axis of rotation and a guide member connected with the frame and configured to receive an advancing web. The apparatus may include a first rotation member connected with the frame and configured to rotate the frame by a first angle of rotation about the first axis of rotation to align a machine direction centerline of the advancing web with a target cross-directional position. The apparatus comprises a second rotation member connected with the frame and configured to rotate the frame about a second axis of rotation by a second angle of rotation to adjust the target cross-directional position, wherein the second angle of rotation is greater than the first angle of rotation.

20 Claims, 19 Drawing Sheets

(56) References Cited

U.S. PATENT DOCUMENTS 4,181,555 A 1/1980 Hoffmann
4,220,237 A 9/1980 Mohn
4,275,807 A 6/1981 Mohn et al.
4,297,157 A 10/1981 Van Vliet
4,333,790 A 6/1982 Schaffron
4,429,781 A 2/1984 Holzhauser
4,456,114 A 6/1984 Mohn
4,487,650 A 12/1984 Mohn et al.
4,574,022 A 3/1986 Johnson et al.
4,578,133 A 3/1986 Oshefsky et al.
4,608,115 A 8/1986 Schroth et al.
4,610,751 A 9/1986 Eschler
4,617,082 A 10/1986 Oshefsky et al.
4,632,721 A 12/1986 Hoffmann et al.
4,642,150 A 2/1987 Stemmler
4,648,928 A 3/1987 Ales
4,685,342 A 8/1987 Brackett
4,688,902 A 8/1987 Gardam
4,722,432 A 2/1988 Staton
4,726,874 A 2/1988 Van Vliet
4,726,876 A 2/1988 Tomsovic, Jr.
4,738,348 A 4/1988 Sillner
4,758,293 A 7/1988 Samida
4,760,626 A 8/1988 Loenner et al.
4,767,487 A 8/1988 Tomsovic, Jr.
4,786,046 A 11/1988 Freeman et al.
4,813,946 A 3/1989 Sabee
4,821,638 A 4/1989 Uithoven
4,834,741 A 5/1989 Sabee
4,838,969 A 6/1989 Nomura et al.
4,838,982 A 6/1989 Klaeser et al.
4,848,632 A 7/1989 Mack et al.
4,863,542 A 9/1989 Oshefsky et al.
4,880,102 A 11/1989 Indrebo
4,908,247 A 3/1990 Baird et al.
4,911,285 A 3/1990 Rogall et al.
4,921,387 A 5/1990 Bennington
4,925,520 A 5/1990 Beaudoin et al.
4,940,464 A 7/1990 Van Gompel et al.
4,941,939 A 7/1990 Nomura et al.
4,960,186 A 10/1990 Honda
4,968,313 A 11/1990 Sabee
4,995,928 A 2/1991 Sabee
5,025,910 A 6/1991 Lasure et al.
5,046,272 A 9/1991 Vogt et al.
5,091,039 A 2/1992 Ujimoto et al.
5,092,861 A 3/1992 Nomura et al.
5,092,862 A 3/1992 Muckenfuhs et al.
5,104,116 A 4/1992 Pohjola
5,116,452 A 5/1992 Eder
5,143,679 A 9/1992 Weber et al.
5,149,392 A 9/1992 Plaessmann
5,156,793 A 10/1992 Buell et al.
5,167,897 A 12/1992 Weber et al.
5,177,841 A 1/1993 Hamuro et al.
5,188,212 A 2/1993 Munsch
5,224,405 A 7/1993 Pohjola
5,235,515 A 8/1993 Ungpiyakul et al.
5,246,433 A 9/1993 Hasse et al.
5,305,653 A 4/1994 Ohtani et al.
5,360,420 A 11/1994 Cook et al.
5,380,381 A 1/1995 Otruba
5,413,651 A 5/1995 Otruba
5,429,694 A 7/1995 Herrmann
5,500,075 A 3/1996 Herrmann
5,540,146 A 7/1996 Lapp
5,556,504 A 9/1996 Rajala et al.
5,569,234 A 10/1996 Buell et al.
5,582,668 A 12/1996 Kling
5,584,954 A 12/1996 Van der Klugt
5,591,297 A 1/1997 Ahr
5,591,298 A 1/1997 Goodman et al.
5,599,335 A 2/1997 Goldman et al.
5,643,396 A 7/1997 Rajala et al.
5,643,588 A 7/1997 Roe et al.
5,660,657 A 8/1997 Rajala et al.
5,660,664 A 8/1997 Herrmann
5,660,665 A 8/1997 Jalonen
5,674,216 A 10/1997 Buell et al.
5,684,344 A 11/1997 Takei
5,693,195 A 12/1997 Saito et al.
5,695,963 A 12/1997 McKnight et al.
5,702,551 A 12/1997 Huber et al.
5,709,770 A 1/1998 Asghar et al.
5,716,478 A 2/1998 Boothe et al.
5,735,996 A 4/1998 Asghar et al.
5,759,340 A 6/1998 Boothe et al.
5,766,406 A 6/1998 Bohn et al.
5,776,289 A 7/1998 Steidinger
5,783,032 A 7/1998 O'Callaghan et al.
5,837,087 A 11/1998 Ahr
5,849,143 A 12/1998 Ingalls
5,850,711 A 12/1998 Takahashi et al.
5,888,343 A 3/1999 Olson
5,895,555 A 4/1999 Van Den Bergh
5,897,545 A 4/1999 Kline et al.
5,901,530 A 5/1999 Draghetti et al.
5,932,039 A 8/1999 Popp et al.
5,957,908 A 9/1999 Kline et al.
5,965,963 A 10/1999 Chitayat
5,968,025 A 10/1999 Roe et al.
5,994,798 A 11/1999 Chitayat
6,022,443 A 2/2000 Rajala et al.
6,059,710 A 5/2000 Rajala et al.
6,074,333 A 6/2000 Rajala et al.
6,086,694 A 7/2000 Winter et al.
6,107,537 A 8/2000 Elder et al.
6,118,041 A 9/2000 Roe et al.
6,120,487 A 9/2000 Ashton
6,120,489 A 9/2000 Johnson et al.
6,139,004 A 10/2000 Couillard et al.
6,149,755 A 11/2000 McNichols et al.
6,153,209 A 11/2000 Vega et al.
6,165,306 A 12/2000 Rajala
6,170,636 B1 1/2001 Een et al.
6,250,357 B1 6/2001 Niedermeyer
6,254,714 B1 7/2001 Niedermeyer
6,284,081 B1 9/2001 Vogt et al.
6,287,409 B1 9/2001 Stephany
6,319,347 B1 11/2001 Rajala et al.
6,322,547 B1 11/2001 Hansson
6,325,201 B1 12/2001 Bailey et al.
6,350,070 B1 2/2002 Tasma
6,375,769 B1 4/2002 Quereshi et al.
6,410,129 B2 6/2002 Zhang et al.
6,422,375 B1 7/2002 Hellman et al.
6,426,444 B2 7/2002 Roe et al.
6,431,241 B1 8/2002 Gonzalo
6,440,246 B1 8/2002 Vogt et al.
6,450,321 B1 9/2002 Blumenthal et al.
6,471,036 B1 10/2002 Schlisio
6,474,528 B2 11/2002 Scharschinger et al.
6,520,236 B1 2/2003 Rajala
6,527,902 B1 3/2003 Rajala
6,533,879 B2 3/2003 Quereshi et al.
6,540,857 B1 4/2003 Coenen et al.
6,544,375 B1 4/2003 Schmitz
6,550,517 B1 4/2003 Hilt et al.
6,569,275 B1 5/2003 Popp et al.
6,585,841 B1 7/2003 Popp et al.
6,586,652 B1 7/2003 Roe et al.
6,590,136 B1 7/2003 Young et al.
6,604,623 B2 8/2003 Sumi et al.
6,613,033 B1 9/2003 Popp et al.
6,617,016 B2 9/2003 Zhang et al.
6,617,490 B1 9/2003 Chen et al.
6,620,276 B1 9/2003 Kuntze et al.
6,627,787 B1 9/2003 Roe et al.
6,635,041 B1 10/2003 Popp et al.
6,648,122 B1 11/2003 Hirsch et al.
6,652,504 B1 11/2003 Olson et al.
6,656,312 B1 12/2003 Schmitz et al.
6,689,115 B1 2/2004 Popp et al.
6,692,196 B1 2/2004 Simm et al.

(56) References Cited

U.S. PATENT DOCUMENTS

| | | | |
|---|---|---|---|
| 6,692,603 | B1 | 2/2004 | Lindsay et al. |
| 6,705,453 | B2 | 3/2004 | Blumenthal et al. |
| 6,722,494 | B2 | 4/2004 | Nakakado |
| 6,748,996 | B2 | 6/2004 | Nakakado et al. |
| 6,758,109 | B2 | 7/2004 | Nakakado |
| 6,766,217 | B1 | 7/2004 | Hamada |
| 6,766,843 | B2 | 7/2004 | Hilt et al. |
| 6,808,582 | B2 | 10/2004 | Popp et al. |
| 6,811,019 | B2 | 11/2004 | Christian et al. |
| 6,814,217 | B2 | 11/2004 | Blumenthal et al. |
| 6,820,671 | B2 | 11/2004 | Clavert |
| 6,825,393 | B2 | 11/2004 | Roe et al. |
| 6,832,679 | B2 | 12/2004 | Berndtsson |
| 6,848,566 | B2 | 2/2005 | Harnish et al. |
| 6,860,531 | B2 | 3/2005 | Sherwin |
| 6,861,571 | B1 | 3/2005 | Roe et al. |
| 6,866,137 | B2 | 3/2005 | Ohiro et al. |
| 6,895,649 | B2 | 5/2005 | Kojo et al. |
| 6,899,780 | B2 | 5/2005 | Rajala et al. |
| 6,918,485 | B2 | 7/2005 | Holston et al. |
| 6,942,086 | B2 | 9/2005 | Bridges et al. |
| 7,013,941 | B2 | 3/2006 | Schneider et al. |
| 7,045,031 | B2 | 5/2006 | Popp et al. |
| 7,093,705 | B2 | 8/2006 | Ohiro et al. |
| 7,134,258 | B2 | 11/2006 | Kalany et al. |
| 7,179,343 | B2 | 2/2007 | VanEperen et al. |
| 7,195,684 | B2 | 3/2007 | Satoh |
| 7,216,685 | B2 | 5/2007 | Nakakado et al. |
| 7,252,131 | B2 | 8/2007 | Draghetti et al. |
| 7,278,203 | B2 | 10/2007 | Aoyama et al. |
| 7,341,087 | B2 | 3/2008 | Tabor et al. |
| 7,398,870 | B2 | 7/2008 | McCabe |
| 7,533,709 | B2 | 5/2009 | Meyer |
| 7,543,697 | B2 | 6/2009 | Legallais |
| 7,569,039 | B2 | 8/2009 | Matsuda et al. |
| 7,587,966 | B2 | 9/2009 | Nakakado et al. |
| 7,643,904 | B2 | 1/2010 | Aoyama et al. |
| 7,721,872 | B2 | 5/2010 | Aoyama et al. |
| 7,770,712 | B2 | 8/2010 | McCabe |
| 7,841,633 | B2 | 11/2010 | Nankervis et al. |
| 8,430,226 | B2 | 4/2013 | Tokunaga et al. |
| 8,607,959 | B2 | 12/2013 | Papsdorf et al. |
| 8,720,666 | B2 | 5/2014 | Papsdorf et al. |
| 2001/0040178 | A1 | 11/2001 | Scharschinger et al. |
| 2002/0112939 | A1 | 8/2002 | Sumi et al. |
| 2002/0125105 | A1 | 9/2002 | Nakakado |
| 2003/0079330 | A1 | 5/2003 | Stopher et al. |
| 2003/0233082 | A1 | 12/2003 | Kline et al. |
| 2004/0089516 | A1 | 5/2004 | Christian et al. |
| 2004/0144619 | A1 | 7/2004 | Ohiro et al. |
| 2004/0144620 | A1 | 7/2004 | Ohiro et al. |
| 2004/0154161 | A1 | 8/2004 | Aoyama et al. |
| 2004/0245069 | A1 | 12/2004 | Hook et al. |
| 2004/0262127 | A1 | 12/2004 | Harnish et al. |
| 2005/0082141 | A1 | 4/2005 | Dombek |
| 2005/0107764 | A1 | 5/2005 | Matsuda et al. |
| 2006/0185135 | A1 | 8/2006 | Yamamoto et al. |
| 2007/0074953 | A1 | 4/2007 | McCabe |
| 2007/0219521 | A1 | 9/2007 | Hird et al. |
| 2007/0227858 | A1 | 10/2007 | Aoyama et al. |
| 2008/0005895 | A1 | 1/2008 | Aoyama et al. |
| 2008/0023296 | A1 | 1/2008 | Aoyama et al. |
| 2008/0196564 | A1 | 8/2008 | McCabe |
| 2008/0276439 | A1 | 11/2008 | Andrews et al. |
| 2009/0312739 | A1 | 12/2009 | Umebayahi et al. |
| 2010/0012458 | A1 | 1/2010 | Giuliani et al. |
| 2010/0172723 | A1 | 7/2010 | Schneider |
| 2010/0258240 | A1 | 10/2010 | McCabe et al. |
| 2010/0270126 | A1 | 10/2010 | Piantoni et al. |
| 2010/0300838 | A1 | 12/2010 | McCabe |
| 2010/0326796 | A1 | 12/2010 | Walsh |
| 2011/0139657 | A1 | 6/2011 | Hird et al. |
| 2011/0139658 | A1 | 6/2011 | Hird et al. |
| 2011/0139659 | A1 | 6/2011 | Hird et al. |
| 2011/0139662 | A1 | 6/2011 | Hird et al. |
| 2011/0152812 | A1 | 6/2011 | Hird et al. |
| 2011/0287918 | A1 | 11/2011 | Ogasawara et al. |
| 2012/0012439 | A1 | 1/2012 | Yamamoto |
| 2012/0061015 | A1 | 3/2012 | LaVon et al. |
| 2012/0061016 | A1 | 3/2012 | LaVon et al. |
| 2013/0091998 | A1 | 4/2013 | Yamamoto et al. |
| 2013/0152360 | A1 | 6/2013 | Schoultz et al. |
| 2013/0153365 | A1 | 6/2013 | Schoultz |
| 2013/0270065 | A1 | 10/2013 | Papsdorf et al. |
| 2014/0102851 | A1 | 4/2014 | Papsdorf et al. |

FOREIGN PATENT DOCUMENTS

| | | |
|---|---|---|
| JP | 01131372 | 5/1989 |
| JP | H05 43095 A | 2/1993 |
| JP | H11 139639 A | 5/1999 |
| JP | 2005212149 | 8/2005 |

212

APPARATUS FOR POSITIONING AN ADVANCING WEB

FIELD

The present disclosure generally relates to an apparatus for manufacturing absorbent articles, and, more particularly, relates to an apparatus for controlling the position of an advancing web.

BACKGROUND

Absorbent articles, such as taped diapers or pant diapers, for example, may be manufactured by a process where discrete articles, such as a chassis of a taped diaper or a pant diaper including a topsheet, a backsheet, and an absorbent core, for example, are applied to one or more moving webs of components, such as continuous webs of front and rear waistbands, for example. In some processes, a continuous length of waistband web advancing in a machine direction may be cut along the machine direction into front and rear waistband webs. Prior to joining the two continuous lengths of front and rear waistband webs with discrete chassis, the front and rear waistband webs may need to be spaced apart from each other in a cross direction. For producing different size absorbent articles, the front and rear waistband webs may need to be cross-directionally spaced apart by different amounts. That is, as the size of the absorbent article increases, the spacing between the front and rear waistband webs may increase.

Some manufacturing processes utilize a web spacing device to control the cross-directional position of an advancing web. For example, an advancing web may define a machine direction centerline that is equidistant from longitudinal side edges of the web. The web spacing device may maintain the machine direction centerline of the web in line with a target cross-directional position. Such a web spacing device may also be used to shift the web such that the machine direction centerline of the web is shifted in the cross direction. However, such a web spacing device may be incapable of shifting the front and rear waistband webs far enough apart in the cross direction in preparation for joining the front and rear waistband webs with the discrete chassis. Furthermore, such web spacing devices may be configured for manufacturing absorbent articles of a predetermined size. As a result, separate web spacing devices may be needed for cross-directionally spacing front and rear waistband webs for manufacturing different size absorbent articles.

Therefore, it would be beneficial to provide a web spacing device that is capable of cross-directionally shifting an advancing web by a relatively large degree. Moreover, it would be beneficial to provide a web spacing device that is capable of cross-directionally shifting an advancing web or webs for the production of absorbent articles of various sizes.

SUMMARY

Aspects of the present disclosure include an apparatus for controlling cross-directional movement of a web advancing in a machine direction. The web defines a machine direction centerline. The apparatus comprises a frame having a first end portion and a second end portion separated by a central portion, wherein the frame is rotatable about a first axis of rotation. The apparatus comprises first rotation member movably connected with the frame, wherein the first rotation member is configured to rotate the frame by a first angle of rotation about the first axis of rotation. The apparatus further comprises a second rotation member movably connected with the frame, wherein the second rotation member is configured to rotate the frame about a second axis of rotation by a second angle of rotation. The second angle of rotation is greater than the first angle of rotation.

Aspects of the present disclosure include an apparatus comprising a frame having a first end portion and a second end portion separated by a central portion and a rotation member rotatably connected with the frame. The rotation member is configured to rotate the frame about an axis of rotation. The rotation member comprises a rotation aperture and a locking member, wherein the locking member is connected with the frame and associated with the rotation aperture. The locking member is positionable in various locations along the rotation aperture to adjust the orientation of the frame.

Aspects of the present disclosure include a method for controlling cross-directional movement of a web advancing in a machine direction using a web spacing device. The web spacing device comprises a frame having a first end portion and a second end portion separated by a central portion, wherein the frame is rotatable about a first axis of rotation. The web spacing device further comprises a first rotation member movably connected with the frame, wherein the first rotation member is configured to rotate the frame by a first angle of rotation about the first axis of rotation. The web spacing device further comprises a second rotation member movably connected with the frame, wherein the second rotation member is configured to rotate the frame about a second axis of rotation by a second angle of rotation. The second angle of rotation is greater than the first angle of rotation. The web defines a machine direction centerline. The method comprises the steps of: rotating the frame about the second axis of rotation using the second rotation member to position the web spacing device in a first configuration; advancing a first web in a machine direction onto the web spacing device; shifting the machine direction centerline of the first web in a cross direction; aligning the machine direction centerline of the first web with a first target cross-directional position; rotating the frame about the second axis of rotation using the second rotation member to position the web spacing device in a second configuration; advancing a second web in a machine direction onto the web spacing device; shifting the machine direction centerline of the second web in the cross direction; and aligning the machine direction centerline of the second web with a second target cross-directional position that is different from the first target cross-directional position.

DETAILED DESCRIPTION

Figure 1:
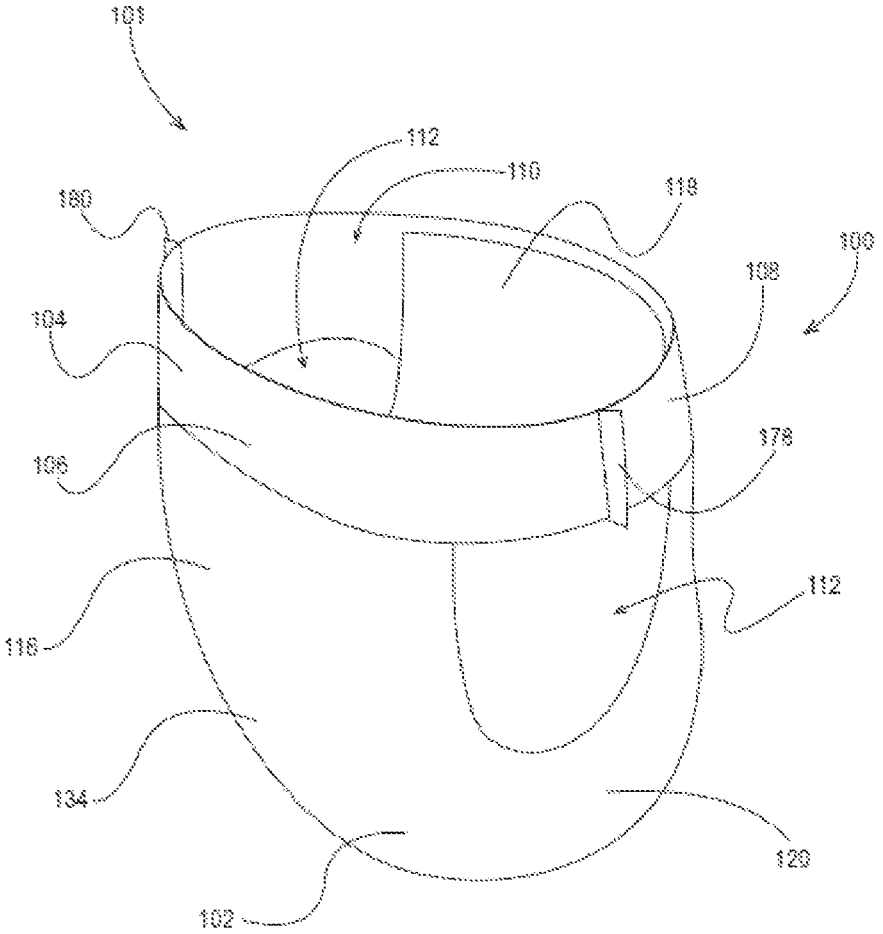
FIG. 1 is a schematic, perspective view of a diaper pant.

Various non-limiting exemplary configurations of the present disclosure will now be described to provide an overall understanding of the principles of the structure, function, manufacture, and use of the apparatuses for transferring discrete articles disclosed herein. One or more examples of these non-limiting exemplary configurations are illustrated in the accompanying drawings. Those of ordinary skill in the art will understand that the apparatuses for transferring discrete articles described herein and illustrated in the accompanying drawings are non-limiting example configurations and that the scope of the various non-limiting configurations of the present disclosure are defined solely by the claims. The features illustrated or described in connection with one non-limiting exemplary configuration may be combined with the features of other non-limiting exemplary configurations. Such modifications and variations are intended to be included within the scope of the present disclosure.

The following definitions may be useful in understanding the present disclosure.

"Absorbent article" is used herein to refer to consumer products that primarily functions to absorb and retain soils and wastes. "Diaper" is used herein to refer to an absorbent article generally worn by infants and incontinent persons about the lower torso. The term "disposable" is used herein to describe absorbent articles which generally are not intended to be laundered or otherwise restored or reused as an absorbent article (for example, they are intended to be discarded after a single use and may also be configured to be recycled, composted or otherwise disposed of in an environmentally compatible manner).

"Longitudinal" means a direction running substantially perpendicular from a waist edge to a longitudinally opposing waist edge of an absorbent article when the article is in a flat out, uncontracted state, or from a waist edge to the bottom of the crotch, i.e. the fold line, in a bi-folded article. Directions within 45 degrees of the longitudinal direction are considered to be "longitudinal." "Lateral" refers to a direction running from a longitudinally extending side edge to a laterally opposing longitudinally extending side edge of an article and generally at a right angle to the longitudinal direction. Directions within 45 degrees of the lateral direction are considered to be "lateral."

"Substrate" is used herein to describe a material which is primarily two-dimensional (i.e. in an XY plane) and whose thickness (in a Z direction) is relatively small (i.e. 1/10 or less) in comparison to the substrate's length (in an X direction) and width (in a Y direction). Non-limiting examples of substrates include a web, layer or layers or fibrous materials, nonwovens, films and foils such as polymeric films or metallic foils. These materials may be used alone or may comprise two or more layers joined together. As such, a web is a substrate.

"Nonwoven" refers herein to a material made from continuous (long) filaments (fibers) and/or discontinuous (short) filaments (fibers) by processes such as spunbonding, meltblowing, carding, and the like. Nonwovens do not have a woven or knitted filament pattern.

"Machine direction" (MD) is used herein to refer to the direction of material flow through a process. In addition, relative placement and movement of material can be described as flowing in the machine direction through a process from upstream in the process to downstream in the process. "Cross direction" (CD) is used herein to refer to a direction that is not parallel with, and usually perpendicular to, the machine direction.

"Pant" (also referred to commercially as "training pant", "pre-closed diaper", "pant diaper", "diaper pant", and "pull-on diaper") refers herein to disposable absorbent articles having a continuous perimeter waist opening and continuous perimeter leg openings designed for infant or adult wearers. A pant can be configured with a continuous or closed waist opening and at least one continuous, closed, leg opening prior to the article being applied to the wearer. A pant can be preformed by various techniques including, but not limited to, joining together portions of the article using any refastenable and/or permanent closure member (for example, seams, heat bonds, pressure welds, adhesives, cohesive bonds, mechanical fasteners, etc.). A pant can be preformed anywhere along the circumference of the article in the waist region (for example, side fastened or seamed, front waist fastened or seamed, rear waist fastened or seamed).

Values disclosed herein as ends of ranges are not to be understood as being strictly limited to the exact numerical values recited. Instead, unless otherwise specified, each numerical range is intended to mean both the recited values, any integers within the specified range, and any ranges with the specified range. For example a range disclosed as "1 to 10" is intended to mean "1, 2, 3, 4, 5, 6, 7, 8, 9, 10."

The present disclosure includes an apparatus for controlling the cross-directional position of a continuous web advancing in a machine direction. The apparatus may be configured as a web spacing device. An advancing continuous web may define a machine direction centerline that is equidistant from longitudinal side edges of the continuous web. Sometimes, during operation, a continuous web advancing in the machine direction may undesirably shift in the cross direction as a result of various operating conditions. If the machine direction centerline of the web is positioned away from a target cross-directional position, components of the resulting absorbent articles may be misaligned. As such, the web spacing device of the present disclosure may control the cross-directional position of the continuous web by maintaining the machine direction centerline of the web at a target cross-directional position, or within a predetermined distance of the target cross-directional position.

Furthermore, the web spacing device of the present disclosure may be used to cross-directionally shift a continuous web advancing in the machine direction. As a result, not only does the web spacer device act to correct cross-directional movement of the web relative to the target cross-directional position, but the web spacing device may also act to change the cross-directional position of the advancing web or webs from a first target cross-directional position to a second target cross-directional position that is different from the first target cross-directional position.

The web spacing device may include a frame that is rotatable about a first axis of rotation. The frame may be associated with a first rotation member. The first rotation member may be configured to rotate the frame by a first angle of rotation about the first axis of rotation. The apparatus may comprise a second rotation member that is rotatably connected with the frame. The second rotation member may be configured to rotate the frame by a second angle of rotation about a second axis of rotation, wherein the second angle of rotation is greater than the first angle of rotation. In some exemplary configurations, the first axis of rotation and the second axis of rotation may be the same.

The apparatus may comprise a guide member having an outer surface, wherein the guide member is connected with the frame. The guide member may be in the form of first guide member and a second guide member. The first and second guide members each have an outer surface. The apparatus may be configured to control the cross-directional positioning of a web advancing in a machine direction. The outer surface of the first guide member may be configured to receive an advancing web. The outer surface of the second guide member may be configured to receive the advancing web advancing from the outer surface of the first guide member. The first rotation member may be configured to rotate the frame about the first axis of rotation to align the advancing web with a target cross-directional position. The second rotation member may be configured to rotate the frame about the second axis of rotation to adjust the target cross-directional position. By adjusting the target cross-directional position, an advancing web may advance onto the first guide member at a first cross-directional position and may advance onto the second guide member at a second cross-directional position that is different from the first cross-directional position.

In some exemplary configurations, the first rotation member may comprise a base associated with a motor, a sensor, and a closed-loop feedback control system to control movement of the frame about the first axis of rotation. The sensor of the first rotation member may be configured to sense the cross-directional position of the machine direction centerline of an advancing web. If the machine direction centerline of the advancing web is positioned away from the target cross-directional position, the sensor may communicate with the motor via the closed-loop feedback control system of the first rotation member. In turn, the motor may rotate the frame about the first axis of rotation to align the machine direction centerline of the advancing web with the target cross-directional position.

The apparatus may further comprise a support member connected with the second rotation member. The second rotation member may be adjustably connectable with the support member in various cross-directional positions. By adjusting the position of the second rotation member relative to the support member, the target cross-directional position of the advancing web may be adjusted.

The web spacing device may be used to space to cross-directionally shift two webs by different degrees. For example, to shift a first web advancing in the machine direction, the web spacing device may be positioned in a first configuration by rotating the frame about the second axis of rotation using the second rotation member. The first web may advance in the machine direction onto the web spacing device in the first configuration. The web spacing device may shift the machine direction centerline of the first web in the cross direction and align the machine direction centerline of the first web with a first target cross-directional position. Then, to shift a second web advancing in the machine direction, the web spacing device may be positioned in a second configuration by rotating the frame about the second axis of rotation using the second rotation member. The second web may advance in the machine direction onto the web spacing device. The web spacing device may shift the machine direction centerline of the second web in the cross direction and align the machine direction centerline of the second web with a second target cross-directional position that is different from the first target cross-directional position.

In some exemplary configurations, the apparatus may comprise a first web spacing device and a second web spacing device. The first web spacing device may be configured to cross-directionally position a first web advancing in the machine direction; likewise, the second web spacing device may be configured to cross-directionally position a second web advancing in the machine direction. The first and second advancing webs may be cut from a single continuous web advancing in the machine direction. The first and second web spacing devices may operate to cross-directionally shift two webs advancing in the machine direction in opposite directions. For example, the first web spacing device may reposition the first web cross-directionally away from the second web and the second web spacing device may reposition the second web cross-directionally away from the first web.

While the apparatus and method of the present disclosure may be used to cross-directionally position a waistband web for an adsorbent article, it is to be appreciated that the methods and apparatuses of the present disclosure may also be suitable for any other uses that require positioning an advancing web or discrete components of an advancing web. These other uses may comprise various manufacturing processes for any product, or intermediate product, in any industry.

As discussed above, the apparatuses disclosed herein may be used to cross-directionally reposition a continuous belt substrate or substrates advancing in a machine direction. To help provide additional context to the subsequent discussion, the following provides a general description of absorbent articles in the form of diapers that include webs, or components of webs, that may be positioned in accordance with the apparatuses and methods disclosed herein.

Figure 2A:
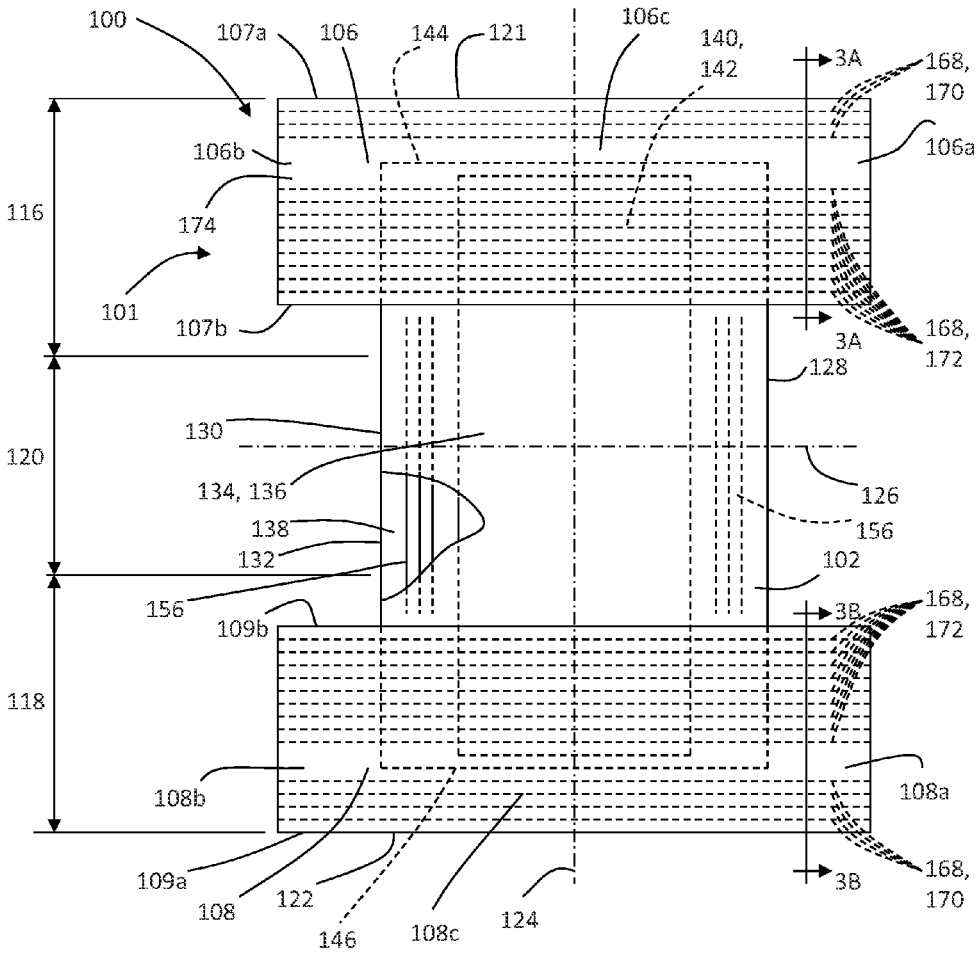
FIG. 2A is a partially cut-away, plan view of a diaper pant.
Figure 2B:
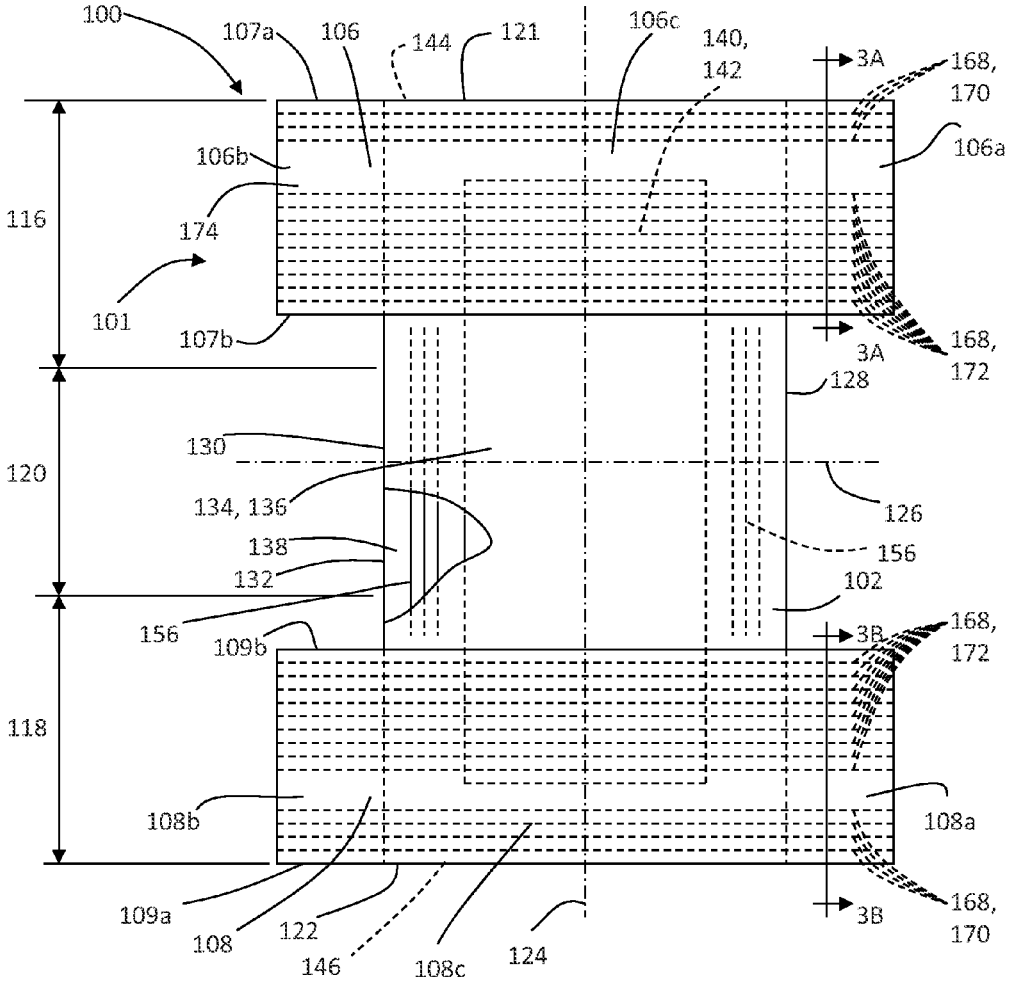
FIG. 2B is a partially cut-away, plan view of a diaper pant.

FIGS. 1, 2A, and 2B show an exemplary absorbent article 100 in the form of a diaper pant 101 that may be formed in accordance with the apparatuses and methods disclosed herein. In particular, FIG. 1 shows a perspective view of a diaper pant 101 in a pre-fastened configuration and FIGS. 2A and 2B show plan views of the diaper pant 101 with the portion of the diaper pant 101 that faces away from a wearer oriented toward the viewer. The diaper pant 101 shown in FIG. 1 includes a chassis 102 and a ring-like elastic belt 104. As discussed below in more detail, a first elastic belt 106 and a second elastic belt 108 are connected together to form the ring-like elastic belt 104.

With continued reference to FIG. 2A, the chassis 102 includes a first waist region 116, a second waist region 118, and a crotch region 120 disposed intermediate the first and second waist regions 116 and 118. The first waist region 116 may be configured as a front waist region, and the second waist region 118 may be configured as back waist region. In some embodiments, the length of each of the front waist region 116, back waist region 118, and crotch region 120 may be one-third of the length of the absorbent article 100. The diaper pant 101 may also include a laterally extending front waist edge 121 in the front waist region 116 and a longitudinally opposing and laterally extending back waist edge 122 in the back waist region 118. To provide a frame of reference for the present discussion, the diaper 101 and chassis 102 of FIG. 2A are shown with a longitudinal axis 124 and a lateral axis 126. In some embodiments, the longitudinal axis 124 may extend through the front waist edge 121 and through the back waist edge 122. The lateral axis 126 may extend through a first longitudinal or right side edge 128 and through a midpoint of a second longitudinal or left side edge 130 of the chassis 102.

As shown in FIGS. 1 and 2A, the diaper pant 101, including the chassis 102 and the first and second belts 106, 108 may include an inner, body facing surface 132, and an outer, garment facing surface 134. The chassis 102 may include a backsheet 136 and a topsheet 138. The chassis 102 may also include an absorbent assembly 140, including an absorbent core 142, disposed between a portion of the topsheet 138 and the backsheet 136. As discussed in more detail below, the diaper pant 101 may also include other features, such as leg elastics and/or leg cuffs to enhance the fit around the legs of the wearer.

As shown in FIG. 2A, the periphery of the chassis 102 may be defined by the first longitudinal side edge 128, a second longitudinal side edge 130, a first laterally extending end edge 144 disposed in the first waist region 116, and a second laterally extending end edge 146 disposed in the second waist region 118. Both side edges 128 and 130 extend longitudinally between the first end edge 144 and the second end edge 146. As shown in FIG. 2A, the laterally extending end edges 144 and 146 are located longitudinally inward from the laterally extending front waist edge 121 in the front waist region 116 and the laterally extending back waist edge 122 in the back waist region 118. When the diaper pant 101 is worn on the lower torso of a wearer, the front waist edge 121 and the back waist edge 122 of the diaper pant 101 may encircle a portion of the waist of the wearer. At the same time, the chassis side edges 128 and 130 may encircle at least a portion of the legs of the wearer. And the crotch region 120 may be generally positioned between the legs of the wearer with the absorbent core 142 extending from the front waist region 116 through the crotch region 120 to the back waist region 118.

Referring to FIG. 2A, the diaper pant 101 may also include elasticized leg cuffs 156. It is to be appreciated that the leg cuffs 156 can be and are sometimes also referred to as leg bands, side flaps, barrier cuffs, elastic cuffs or gasketing cuffs. The elasticized leg cuffs 156 may be configured in various ways to help reduce the leakage of body exudates in the leg regions.

Diaper pants may be manufactured with a ring-like elastic belt 104 and provided to consumers in a configuration wherein the front waist region 116 and the back waist region 118 are connected to each other as packaged, prior to being applied to the wearer. As such, diaper pants 101 may have a continuous perimeter waist opening 110 and continuous perimeter leg openings 112 such as shown in FIG. 1. The ring-like elastic belt 104 is defined by a first elastic belt 106 connected with a second elastic belt 108. As shown in FIG. 2A, the first elastic belt 106 defines first and second opposing end regions 106*a*, 106*b* and a central region 106*c*, and the second elastic 108 belt defines first and second opposing end regions 108*a*, 108*b* and a central region 108*c*. The central region 106*c* of the first elastic belt 106 is connected with the first waist region 116 of the chassis 102, and the central region 108*c* of the second elastic belt 108 is connected with the second waist region 118 of the chassis 102. With reference to FIGS. 1 and 2A, the first end region 106*a* of the first elastic belt 106 is connected with the first end region 108*a* of the second elastic belt 108 at first side seam 178, and the second end region 106*b* of the first elastic belt 106 is connected with the second end region 108*b* of the second elastic belt 108 at second side seam 180 to define the ring-like elastic belt 104 as well as the waist opening 110 and leg openings 112.

Figure 3A:
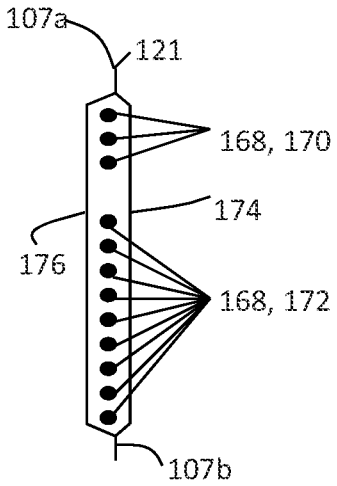
FIG. 3A is a cross-sectional view of the diaper pant of FIGS. 2A and 2B taken along line 3A-3A.
Figure 3B:
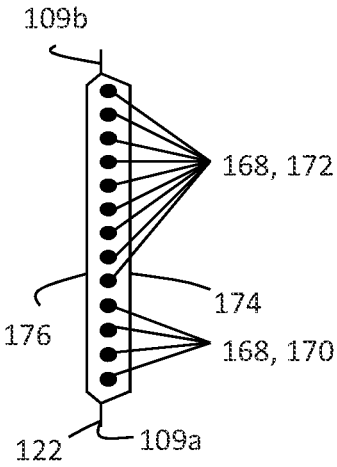
FIG. 3B is a cross-sectional view of the diaper pant of FIGS. 2A and 2B taken along line 3B-3B.

Referring to FIGS. 2A, 3A, and 3B, the first elastic belt 106 also defines an outer lateral edge 107*a* and an inner lateral edge 107*b*, and the second elastic belt 108 defines an outer lateral edge 109*a* and an inner lateral edge 109*b*. The outer lateral edges 107*a*, 109*a* may also define the front waist edge 121 and the laterally extending back waist edge 122. The first elastic belt 106 and the second elastic belt 108 may also each include an outer, garment facing layer 174 and an inner, wearer facing layer 176. It is to be appreciated that the first elastic belt 106 and the second elastic belt 108 may comprise the same materials and/or may have the same structure. In some embodiments, the first elastic belt 106 and the second elastic belt may comprise different materials and/or may have different structures. It should also be appreciated that the first elastic belt 106 and the second elastic belt 108 may be constructed from various materials. For example, the s may be manufactured from materials such as plastic films; apertured plastic films; woven or nonwoven webs of natural materials (e.g., wood or cotton fibers), synthetic fibers (e.g., polyolefins, polyamides, polyester, polyethylene, or polypropylene fibers) or a combination of natural and/or synthetic fibers; or coated woven or nonwoven webs. In some embodiments, the first and second belts include a nonwoven web of synthetic fibers, and may include a stretchable nonwoven. In other embodiments, the first and second belts include an inner hydrophobic, non-stretchable nonwoven material and an outer hydrophobic, non-stretchable nonwoven material.

The first and second belts 106, 108 may also each include belt elastic material interposed between the outer layer 174 and the inner layer 176. The belt elastic material may include one or more elastic elements such as strands, ribbons, or panels extending along the lengths of the elastic belts. As shown in FIGS. 2A, 3A, and 3B, the belt elastic material may include a plurality of elastic strands 168, which may be referred to herein as outer, waist elastics 170 and inner, waist elastics 172. As shown in FIG. 2A, the elastic strands 168 continuously extend laterally between the first and second opposing end regions 106*a*, 106*b* of the first elastic belt 106 and between the first and second opposing end regions 108*a*, 108*b* of the second elastic belt 108. In some embodiments, some elastic strands 168 may be configured with discontinuities in areas, such as for example, where the first and second belts 106, 108 overlap the absorbent assembly 140. In some embodiments, the elastic strands 168 may be disposed at a constant interval in the longitudinal direction. In other embodiments, the elastic strands 168 may be disposed at different intervals in the longitudinal direction. The belt elastic material in a stretched condition may be interposed and joined between the uncontracted outer layer 174 and the uncontracted inner layer 176. When the belt elastic material is relaxed, the belt elastic material returns to an unstretched condition and contracts the outer layer 174 and the inner layer 176. The belt elastic material may provide a desired variation of contraction force in the area of the ring-like elastic belt.

It is to be appreciated that the chassis 102 and elastic belts 106, 108 may be configured in different ways other than as depicted in FIG. 2A. For example, FIG. 2B shows a plan view of a diaper pant 101 having the same components as described above with reference to FIG. 2A, except the first laterally extending end edge 144 of the chassis 102 is aligned along and coincides with the outer lateral edge 107*a* of the first elastic belt 106, and the second laterally extending end edge 146 is aligned along and coincides with the outer lateral edge 109*a* of the second belt 108.

Components of the disposable absorbent article (i.e., diaper, disposable pant, adult incontinence article, sanitary napkin, pantiliner, etc.) described in this specification can at least partially be comprised of bio-sourced content as described in US 2007/0219521A1 Hird et al published on Sep. 20, 2007, US 2011/0139658A1 Hird et al published on Jun. 16, 2011, US 2011/0139657A1 Hird et al published on Jun. 16, 2011, US 2011/0152812A1 Hird et al published on Jun. 23, 2011, US 2011/0139662A1 Hird et al published on Jun. 16, 2011, and US 2011/0139659A1 Hird et al published on Jun. 16, 2011. These components include, but are not limited to, topsheet nonwovens, backsheet films, backsheet nonwovens, side panel nonwovens, barrier leg cuff nonwovens, super absorbent, nonwoven acquisition layers, core wrap nonwovens, adhesives, fastener hooks, and fastener landing zone nonwovens and film bases.

In at least one embodiment, a disposable absorbent article component comprises a bio-based content value from about 10% to about 100% using ASTM D6866-10, method B, in another embodiment, from about 25% to about 75%, and in yet another embodiment, from about 50% to about 60% using ASTM D6866-10, method B.

In order to apply the methodology of ASTM D6866-10 to determine the bio-based content of any disposable absorbent article component, a representative sample of the disposable absorbent article component must be obtained for testing. In at least one embodiment, the disposable absorbent article component can be ground into particulates less than about 20 mesh using known grinding methods (e.g., Wiley® mill), and a representative sample of suitable mass taken from the randomly mixed particles.

Figure 4A:
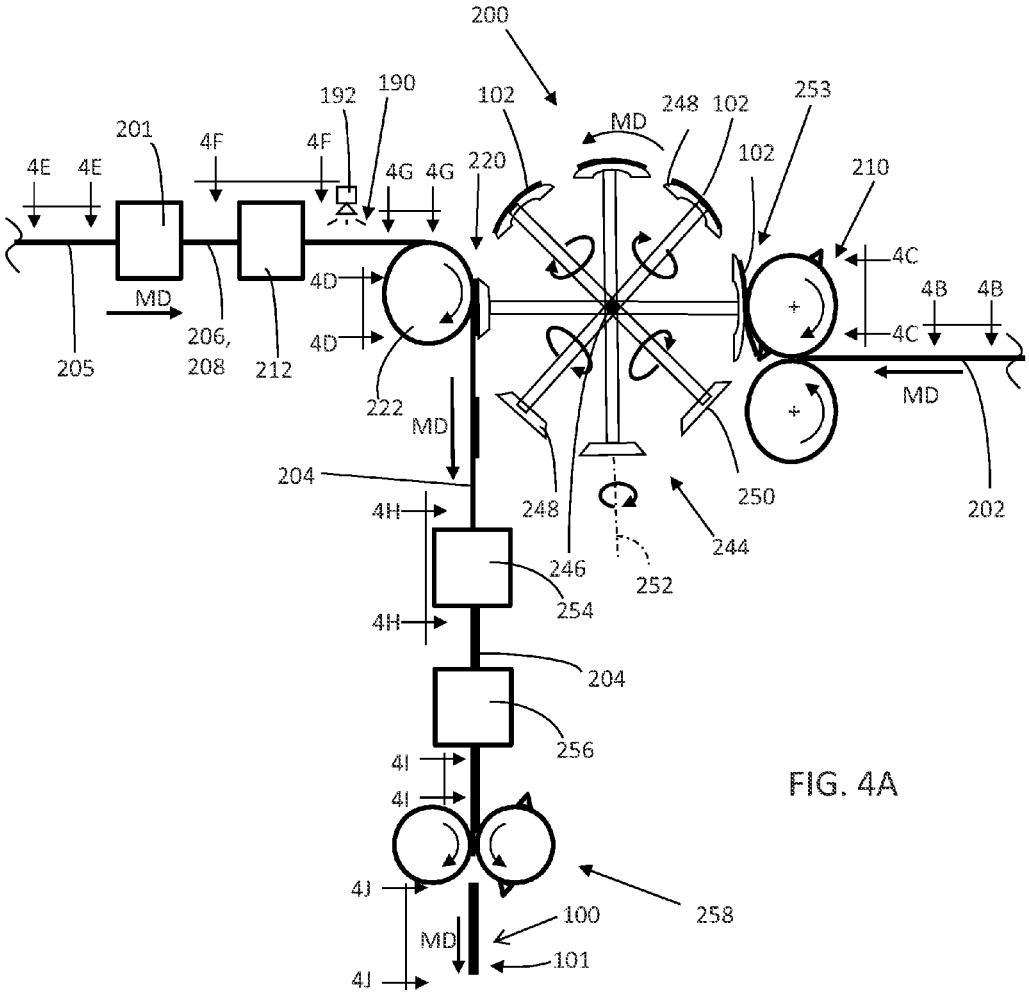
FIG. 4A is a schematic, side elevation view of a converting apparatus.

As previously discussed, the apparatuses and methods of the present disclosure may be used to assemble various components in the manufacture of absorbent articles. For example, FIG. 4A shows a schematic view of a converting apparatus adapted to manufacture diaper pants. The method of operation of the converting apparatus may be described with reference to the various components of the diaper pant 101 described above and shown in FIGS. 1, 2A, and 2B. Although the following methods are provided in the context of the diaper pants shown in FIGS. 1, 2A, and 2B, it is to be appreciated that various types of absorbent articles can be manufactured according the apparatuses and methods disclosed herein, such as for example, the absorbent articles disclosed in U.S. Pat. No. 7,569,039; U.S. Patent Publication No. 2005/0107764; U.S. Patent Application No. 2012/0061016; and U.S. Patent Publication No. 2012/0061015.

With reference to FIG. 4A, and as discussed in more detail below, in operation, a converting apparatus 200 advances a continuous length of chassis assemblies 202 along a machine direction MD such that the longitudinal axis is parallel with the machine direction MD. The continuous length of chassis assemblies 202 are cut into discrete chassis 102. The discrete chassis 102 are then rotated and advanced in the machine direction MD such that the lateral axis is parallel with the machine direction MD. The discrete chassis 102 are combined with continuous lengths of advancing substrates 206, 208. The discrete chassis 102 are then folded along the lateral axis to bring the belt substrates 206, 208 into a facing relationship. The belt substrates 206, 208 are then bonded together to form bonded regions. The belt substrates 206, 208 are then cut along the bonded regions to create discrete diaper pants 101.

Figure 4B:
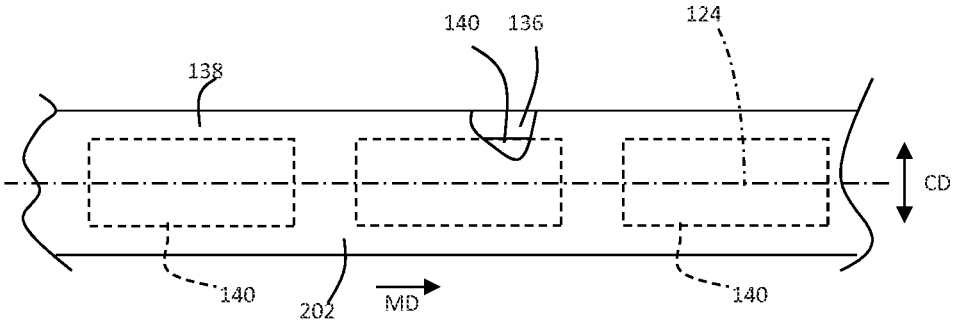
FIG. 4B is a schematic, plan view of a continuous length of chassis assemblies of FIG. 4A taken along lines 4B-4B.

As shown in FIGS. 4A and 4B, a continuous length of chassis assemblies 202 are advanced in a machine direction MD to a cutting device 210 where the continuous length of chassis assemblies 202 is cut into discrete chassis 102. The continuous length of chassis assemblies 202 may include absorbent assemblies 140 sandwiched between topsheet material 138 and backsheet material 136, leg elastics, barrier leg cuffs and the like. A portion of the chassis assembly shown in FIG. 4B is cut-away to show a portion of the backsheet material 136 and an absorbent assembly 140.

After the discrete chassis 102 are cut by the cutting device 210, each chassis 102 are advanced onto a transfer assembly 244. The transfer assembly 244 may include a transfer member 248 having an outer surface 250 on the distal most portion thereof relative to a rotation axis 246. The transfer assembly 244 may rotate about an axis of rotation 246 and the transfer member 248 may rotate about an axis of rotation 252. The outer surface 250 of each transfer member 248 may be flat, or substantially flat, in one or more directions. For example, as shown in FIG. 4A, the outer surface 250 may be flat or substantially flat in one direction, and may be curved in another direction. Substantially flat, as used herein, means the outer surface 250 used to support and transport a discrete article 102 conforms to a plane within about 0-10 mm, and alternatively about 0-5 mm.

Figure 4C:
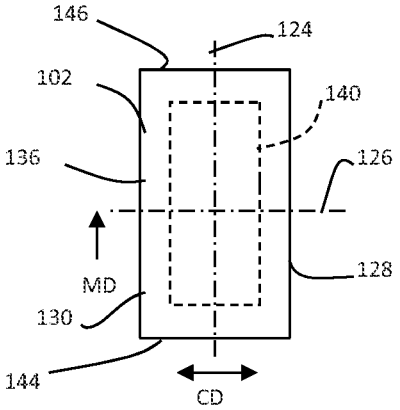
FIG. 4C is a schematic, plan view of a discrete chassis having a longitudinal axis parallel with a machine direction of FIG. 4A taken along line 4C-4C.

The chassis 102 may advance from the cutting device 210 through a nip 253 between the cutting device 210 and the transfer assembly 244 in the orientation shown in FIG. 4C, wherein the longitudinal axis 124 of the chassis 102 is generally parallel with the machine direction MD. The transfer assembly 244 may rotate about the axis of rotation 246 to advance the discrete chassis 102 in the machine direction MD with the second laterally extending end edge 146 as a leading edge and the first laterally extending end edge 144 as the trailing edge. However, it is to be appreciated that in other exemplary configurations, the chassis 102 may be advanced in other orientations. For example, the chassis 102 may be oriented such that the second laterally extending end edge 146 is a trailing edge and the first laterally extending end edge 144 is a leading edge.

Figure 4D:
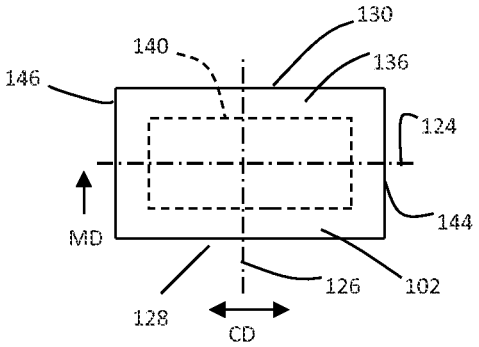
FIG. 4D is a schematic, plan view of a discrete chassis having a lateral axis parallel with the machine direction of FIG. 4A taken along line 4D-4D.

As the transfer assembly 244 advances the discrete chassis 102 in the machine direction MD, the transfer member 248 also rotates the chassis 102 about the axis of rotation 252 to change the orientation of the advancing chassis 102. For example, the transfer member 248 may rotate the chassis from the orientation shown in FIG. 4C to the orientation shown in FIG. 4D, wherein the lateral axis 126 of the chassis 102 generally parallel with the machine direction MD, and wherein the second longitudinal side edge 130 is the leading edge and the first longitudinal side edge 128 is the trailing edge. The transfer assembly 244 may also change the speed at which the chassis 102 advances in the machine direction MD such that the speed of the advancing chassis matches the speed of the advancing substrates 206, 208 advancing downstream. It is to be appreciated that various forms of transfer assemblies may be used with the converting apparatus disclosed herein, such as for example, the transfer assemblies disclosed in U.S. Pat. No. 7,587,966; U.S. patent application Ser. No. 13/447,531, filed on Apr. 16, 2012; U.S. patent application Ser. No. 13/447,544, filed on Apr. 16, 2012; U.S. patent application Ser. No. 13/447,568, filed on Apr. 16, 2012; and U.S. patent application Ser. No. 13/447,585, filed on Apr. 16, 2012.

As discussed below with reference to FIGS. 1, 4A, 4D, 4E, and 4F, each chassis 102 is transferred from the transfer assembly 244 and combined with advancing, continuous first and second belt substrates 206, 208, which are subsequently cut to form first and second belts 106, 108 on absorbent articles 100.

Figure 4E:
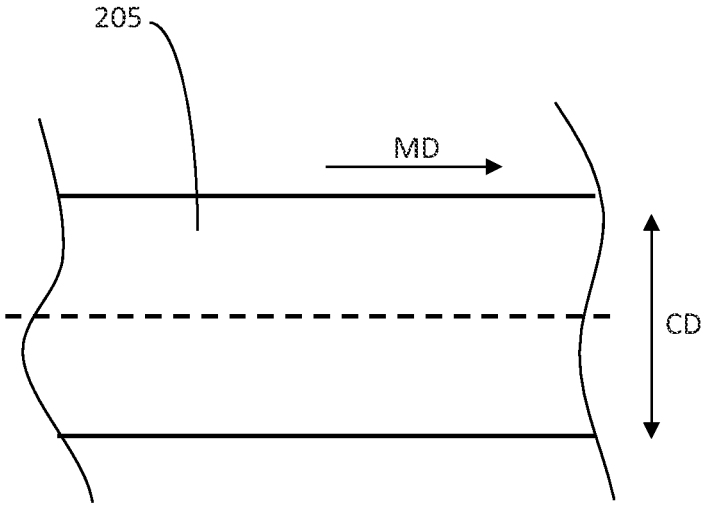
FIG. 4E is a schematic, plan view of a continuous length of belt substrate of FIG. 4A taken along lines 4E-4E.
Figure 4F:
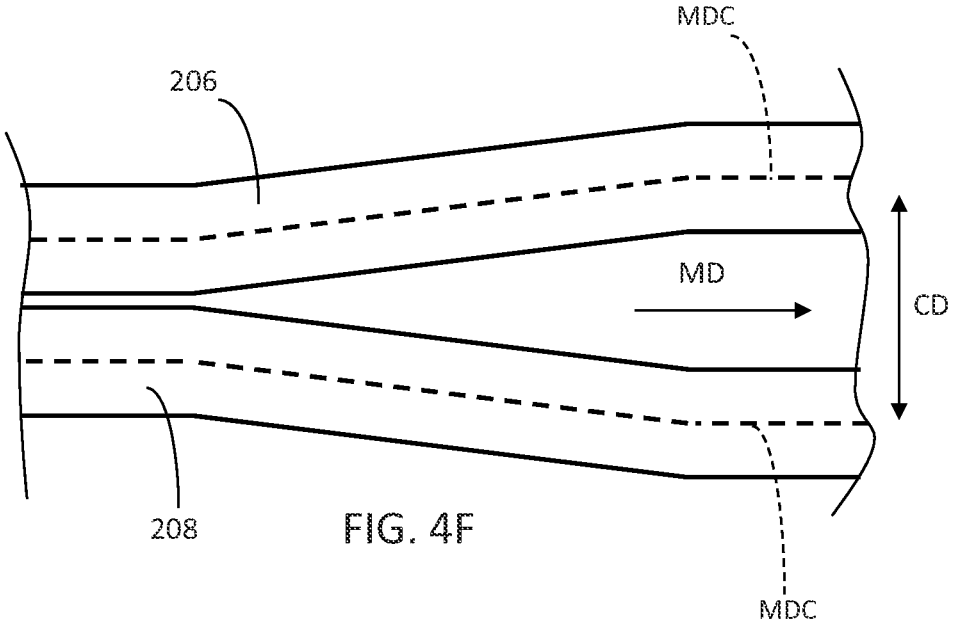
FIG. 4F is a schematic, plan view of continuous lengths of first and second belt substrate of FIG. 4A taken along lines 4F-4F.

Prior to joining each chassis 102 with the advancing, continuous first and second belt substrates 206, 208, the first and second belt substrates 206, 208 may be cut from an advancing continuous belt substrate 205. With reference to FIGS. 4A, 4E, and 4F, upon cutting the first and second belt substrates 206, 208 from the continuous substrate 205, the advancing first and second belt substrates 206, 208 are spaced apart in the cross direction CD at a web spacing device 212. As discussed in more detail below, the first belt substrate 206 is spaced in the cross direction CD by a first web spacing device and the second elastic belt substrate 208 is spaced in the cross direction CD by a second web spacing device.

Figure 4G:
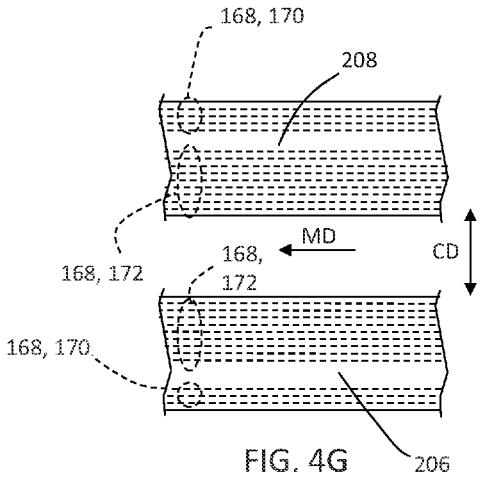
FIG. 4G is a schematic, plan view of continuous lengths of first and second belt substrate of FIG. 4A taken along lines 4G-4G.
Figure 4H:
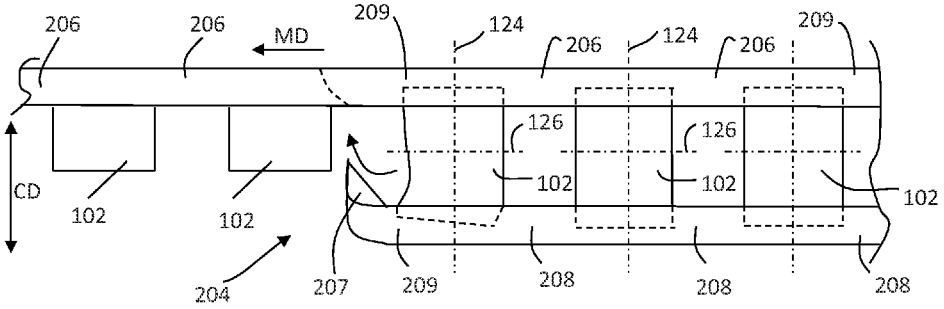
FIG. 4H is a schematic, plan view of a continuous length of diaper pants of FIG. 4A taken along line 4H-4H.

With reference to FIGS. 4A, 4G, and 4H, each chassis 102 is transferred from the transfer assembly 244 to a nip 220 between the transfer assembly 244 and a carrier member 222 where the chassis 102 is combined with belt substrates 206, 208. The belt substrates 206, 208 each define an inner, wearer facing surface 207 and an opposing, outer garment facing surface 209. The inner, wearer facing surface 207 of the first belt substrate 206 may be combined with the outer, garment facing surface 134 of the chassis 102 along the first waist region 116, and the inner, wearer facing surface 207 of the second belt substrate 208 may be combined with the outer, garment facing surface 134 of the chassis 102 along the second waist region 118. As shown in FIG. 4A, adhesive 190 may be intermittently applied by an adhesive applicator 192 to the inner, wearer facing surface 207 of the belt substrates 206, 208 before combining with the discrete chassis 102 at the nip 220 between the transfer assembly 244 and the carrier member 222.

With reference to FIGS. 4A and 4H, a continuous length of absorbent articles 204 are defined by multiple discrete chassis 102 spaced from each other along the machine direction MD and connected with each other by the belt substrates 206, 208. As shown in FIG. 4A, the continuous length of absorbent articles 204 advances from the nip 220 to a folding apparatus 254. At the folding apparatus 254, each chassis 102 is folded in the cross direction CD along a lateral axis 126 to place the first waist region 116, and specifically, the inner, body facing surface 132 into a facing, surface to surface orientation with the inner, body surface 132 of the second waist region 118. The folding of the chassis 102 also positions the inner, wearer facing surface 207 of the second belt substrate 208 extending between each chassis 102 in a facing relationship with the inner, wearer facing surface 207 of the first belt substrate 206 extending between each chassis 102.

Figure 4I:
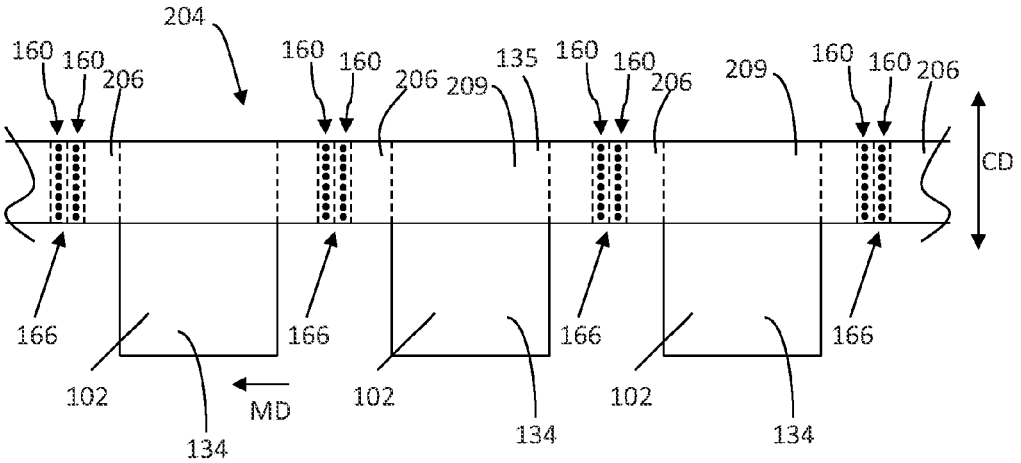
FIG. 4I is a schematic, plan view of a continuous length of folded diaper pants of FIG. 4A taken along line 4I-4I.
Figure 4J:
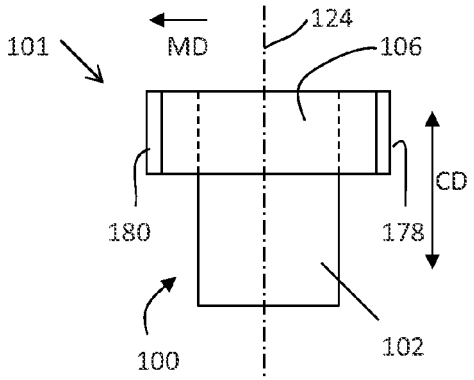
FIG. 4J is a schematic, plan view of a discrete diaper pant of FIG. 4A taken along line 4J-4J.

As shown in FIGS. 4A, 4H, and 4I, the folded discrete chassis 102 connected with the belt substrates 206, 208 are advanced from the folding apparatus 254 to a bonder apparatus 256. The bonder apparatus 256 operates to bond an overlap area 160, thus creating bonded regions 166. The overlap area 160 includes a portion of the second belt substrate 208 extending between each chassis 102 and a portion of the first belt substrate 206 extending between each chassis 102. With reference to FIGS. 4A, 4I, and 4J, the continuous length of absorbent articles 204 are advanced from the bonder apparatus 256 to a cutting device 258 where the bonded regions 166 are cut into along the cross direction CD to create a first side seam 178 on an absorbent article 100 and a second side seam 180 on a subsequently advancing absorbent article.

Figure 5A:
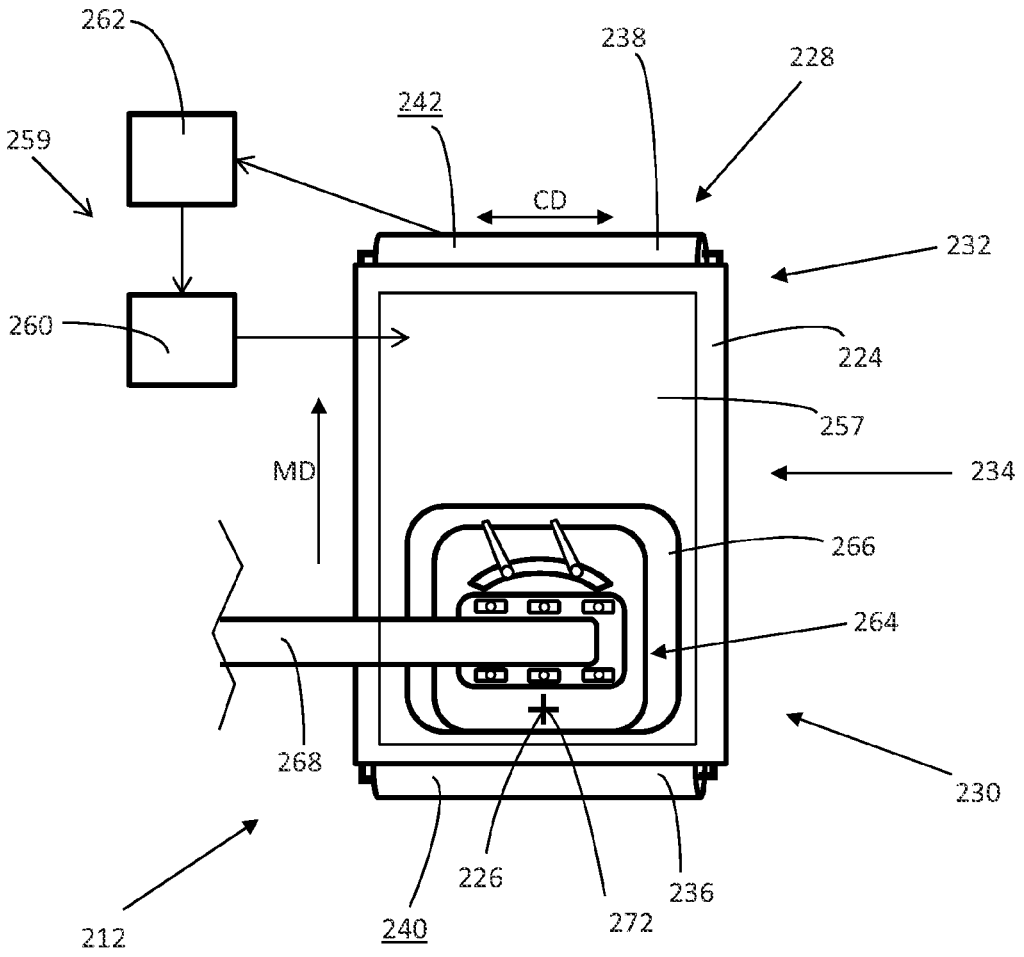
FIG. 5A is a schematic, front elevation view of a web spacing device in a substantially vertical orientation.
Figure 5B:
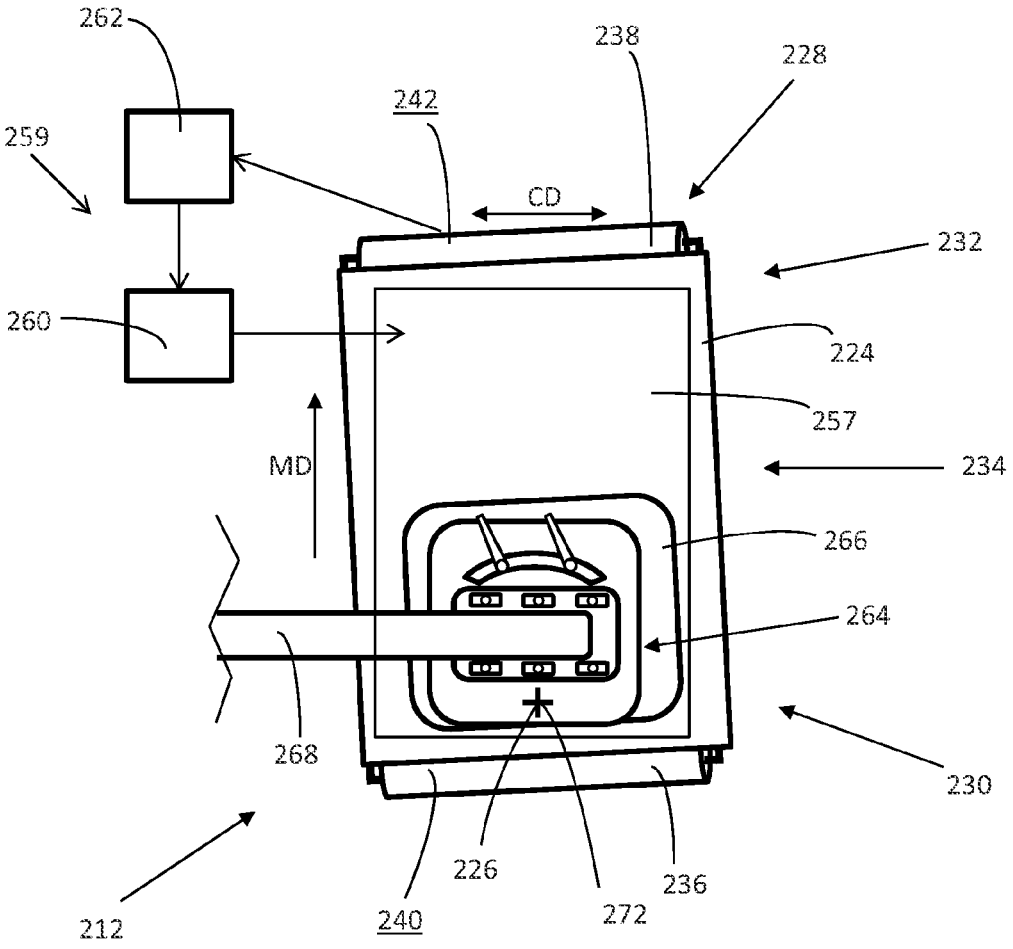
FIG. 5B is a schematic, front elevation view of a web spacing device with a frame rotated relative to a base of a first rotation member.

As discussed above, the present disclosure includes a web spacing device 212. As shown in FIGS. 5A and 5B, the web spacing device 212 may include a frame 224 that is rotatable about a first axis of rotation 226 and a guide member 228 connected with the frame 224. The frame 224 may define a first end portion 230 and a second end portion 232 separated by a central portion 234. The guide member 228 may be configured in the form of first and second guide members 236, 238. The first guide member 236 may be connected with the first end portion 230 of the frame 224 and the second guide member 238 may be connected with the second end portion 232 of the frame 224. The first and second guide members 236, 238 may each define an outer surface 240, 242 that are each configured to receive an advancing web.

With continuing reference to FIG. 5A, the frame 224 may be associated with a first rotation member 259 that is configured to rotate the frame 224 about the first axis of rotation 226. The first rotation member 259 may comprise a base 257 that is associated with a motor 260 and a sensor 262. The first rotation member may be controlled using a closed-loop feedback control system, for example. The base 257 may be connected with the frame 224. The base may be configured in various different ways. As discussed in more detail below, the sensor 262 of the first rotation member 259 may be configured to sense the cross-directional position of the machine direction centerline of an advancing web. If the machine direction centerline of the advancing web is positioned away from the target cross-directional position, the sensor 262 may communicate with the motor 260. In turn, the motor 260 may rotate the frame 224 about the first axis of rotation 226 to align the machine direction centerline of the advancing web with the target cross-directional position. While it is shown that the first rotation member 259 comprises a base 257, a motor 260, and a sensor 262, it is to be appreciated that the first rotation member 259 may comprise various components and may be configured to rotate the frame 224 in various other ways.

As shown in FIG. 5A, the web spacing device 212 may also comprise a second rotation member 264. The web spacing device 212 may also comprise an adapter member 266 that is configured to connect the second rotation member 264 with the frame 224. The second rotation member 264 may be movably, or rotatably, connected with the adapter member 266 and/or the frame 224. The web spacing device 212 may also comprise a support member 268 that connects the second rotation member 264 with a rigid support structure, such as a base, frame, or wall. The second rotation member 264 may be configured to rotate the frame 224 about a second axis of rotation 272. The second axis of rotation 272 may be the same as, or different from, the first axis of rotation 226. That is, the second axis of rotation 272 may be positioned in various locations relative to the frame 224. While the positioning of the first and second axis of rotation 226, 272 shown in FIG. 5A are the same relative to the frame 224, it is to be appreciated that the positioning of the second axis of rotation 272 relative to the frame 224 may be different from the positioning of the first axis of rotation 226 relative to the frame 224.

Figure 6:
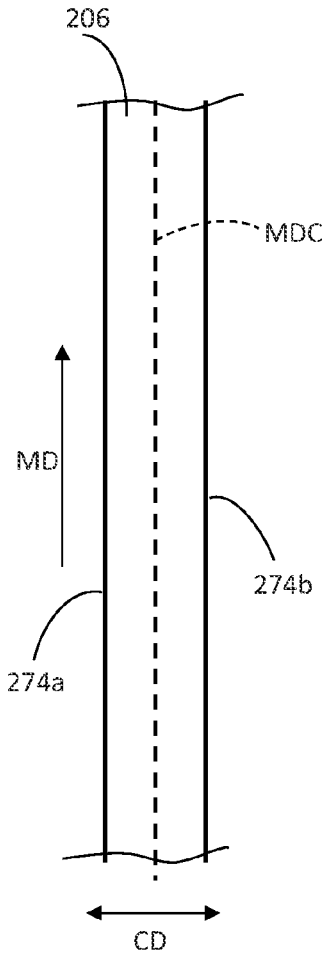
FIG. 6 is a schematic, plan view of a continuous web in the form of a first belt substrate.
Figure 7:
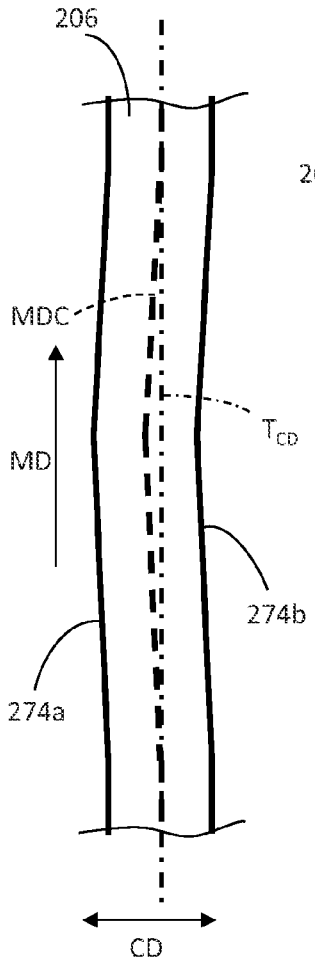
FIG. 7 is a schematic, plan view of a continuous web in the form of a first belt substrate.

As discussed above, the web spacing device 212 may be configured to control the cross-directional CD position of a web, such as the first belt substrate 206 shown in FIG. 6, advancing in the machine direction MD. While the advancing web is described below as the first belt substrate 206, it is to be appreciated that the advancing web may be the second belt substrate 208 shown in FIG. 4F, or various other webs. As shown in FIG. 7, sometimes during operation, the first belt substrate 206, may undesirably shift in the cross direction CD as the first belt substrate 206 advances in the machine direction MD through the converting apparatus. If the first belt substrate 206 is not positioned in a predetermined cross-directional CD position, components of the resulting absorbent articles may be misaligned. As shown in FIGS. 6 and 7, a web, such as the first belt substrate 206, may define a machine direction centerline MDC that is equidistant from two opposing side edges 274*a*, 274*b* of the continuous web that extend in the machine direction MD. With reference to FIGS. 5A, 5B, 6, and 7, the web spacing device 212 may control the cross-directional CD position of the first belt substrate 206 by maintaining the machine direction centerline MDC of the first belt substrate 206 at a target cross-directional position $T_{CD}$, or within a predetermined distance of the target cross-directional position $T_{CD}$.

With reference to FIGS. 5A, 5B, and 7, in operation, the first belt substrate 206 may advance in a machine direction MD onto the outer surface 240 of the first guide member 236 and subsequently advance onto the outer surface 242 of the second guide member 238. From the second guide member 238, the first belt substrate 206 may advance to various downstream operations. If the cross-directional CD position of the machine direction centerline MDC of the first belt substrate 206 is outside of the target cross-directional position $T_{CD}$ as shown in FIG. 7, the sensor 262 is configured to send a signal to the motor 260 of the first rotation member 259 to adjust the cross-directional CD position of the first belt substrate 206. In response, the motor 260 causes the frame 224 to rotate about the first axis of rotation 226. As shown in FIG. 5B, as the frame 224 rotates, the position of the frame 224 relative to the first guide member 259, and particularly, the base 257 of the first guide member 259, changes. The motor 260 may be configured to rotate the frame 224 until the sensor 262 determines that the machine direction centerline MDC of the first belt substrate 206 is at the target cross-directional position $T_{CD}$, or within a predetermined distance of the target cross-directional position. The pre-determined distance may be, for example, within +/−10 millimeters of the target cross-directional position $T_{CD}$. As such, as the first belt substrate 206 advances in the machine direction MD downstream, the first belt substrate 206 may be in proper alignment to join the first belt substrate 206 with various other components of the absorbent article.

Figure 8:
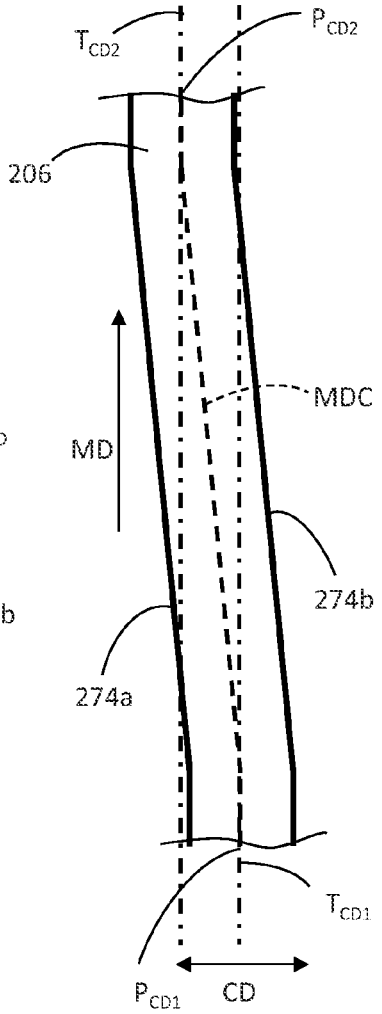
FIG. 8 is a schematic, plan view of a continuous web in the form of a first belt substrate that is shifted in a cross-direction.
Figure 9:
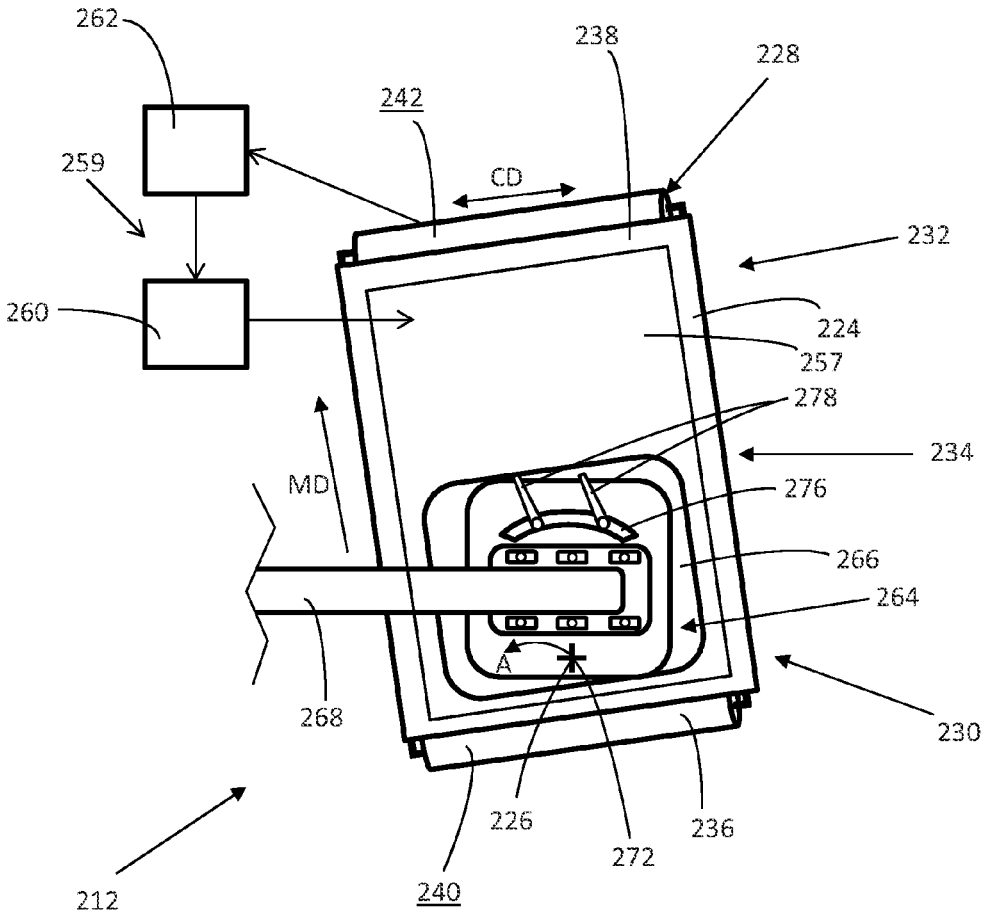
FIG. 9 is a schematic, front elevation view of a web spacing device.
Figure 10:
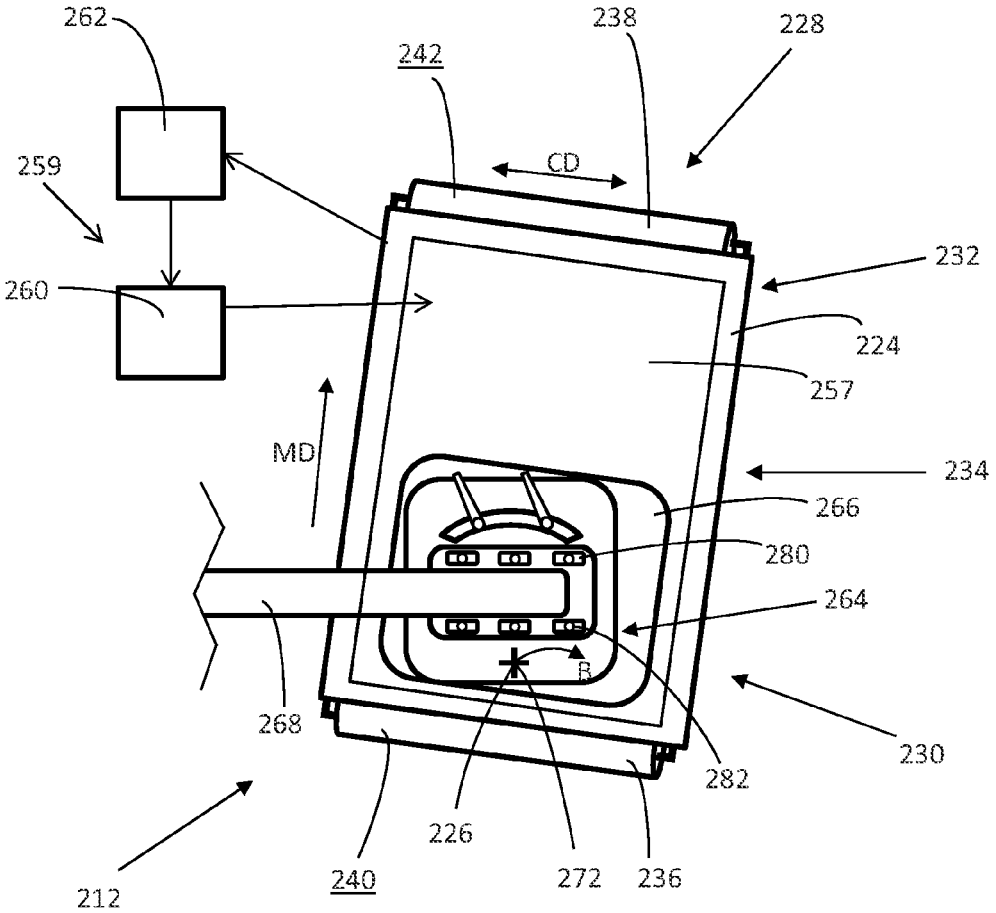
FIG. 10 is a schematic, front elevation view of a web spacing device.

As previously mentioned, the web spacing device 212 may be configured to change the cross-directional CD position of a web, such as the first belt substrate 206, advancing in a machine direction MD. With reference to FIGS. 8 and 9, the second rotation member 264 of the web spacing device 212 may be used to rotate the frame 224 about the second axis of rotation 272, which, in turn, shifts the target cross-directional position of the advancing first belt substrate 206 from a first target cross-directional position $T_{CD1}$ to a second, different target cross-directional position $T_{CD2}$. As a result, as a first belt substrate 206 advances from the first guide member 236 to the second guide member 238, the cross-directional CD position of the machine direction centerline MDC of the first belt substrate 206 shifts in the cross direction CD from a first actual cross-directional position $P_{CD1}$ to a second actual cross-directional position $P_{CD2}$. The web spacing device 212 may shift the machine direction centerline MDC of the first belt substrate 206 by various cross-directional CD distances. That is, the first and second actual cross-directional positions $P_{CD1}$, $P_{CD2}$ may be various distances apart. For example, the web spacing device 212 may shift the machine direction centerline MDC of the first belt substrate 206 by about 25 millimeters to about 300 millimeters, or about 50 millimeters to about 200 millimeters, in the cross direction CD. Moreover, the first rotation member 259 may be configured to control the cross-directional CD position of the first belt substrate 206 at the second target cross-directional position $T_{CD2}$, or within a predetermined distance from the second target cross-directional position $T_{CD2}$. As shown in FIGS. 9 and 10, the second rotation member 264 may be configured to rotate the frame in two directions, A or B, to shift the target cross-directional position $T_{CD}$ of the advancing web.

With continuing reference to FIG. 9, the first rotation member 259 may be configured to rotate the frame 224 about the first axis of rotation 226 by a first angle of rotation and the second rotation member 264 may be configured to rotate the frame 224 about the second axis of rotation 272 by a second angle of rotation. The second angle of rotation may be greater than the first angle of rotation. That is, the second rotation member 264 is configured to cross-directionally shift an advancing web by a greater degree than the first rotation member 259. As such, the web spacing device is capable of positioning an advancing web in various cross-directional positions for the production of various sizes of absorbent articles. For example, the first angle of rotation may be up to +/−10 degrees from vertical. The second angle of rotation may be up to +/−30 degrees, or up to +/−20 degrees, from vertical.

With reference to FIG. 9, in order to change the target cross-directional position for the advancing web, the second rotation member 264 may be configured with a rotation aperture 276 and one or more locking members 278. In some exemplary configurations, the locking members 278 may be connected with the adapter member 266 and may extend through the rotation aperture 276. In other exemplary configurations not comprising an adaptor member, the locking members 278 may be connected directly with the frame 224 and may extend through the rotation aperture 276. Each locking member 278 may be positioned in various locations along the rotation aperture 276 to adjust the orientation of the frame 224. To change the target cross-directional position $T_{CD}$ of the machine direction centerline of an advancing web, the locking member or members 278 of the second rotation member 264 are disengaged from the adapter member 266 and/or the frame 224. Then, the frame 224 may be rotated about the second axis of rotation 272 in directions, A or B. As shown in FIG. 9, as the frame 224 rotates, the position of the frame 224 relative to the second rotation member 264 changes. Once the frame 224 is in the desired position, the locking members 278 may be engaged with the adapter member 266 and/or the frame 224 to prevent the frame 224 from moving about the second axis of rotation 272 during operation. In some exemplary configurations, the second rotation member 264 may be used to manually rotate the frame 224. However, it is to be appreciated that the second rotation member 264 may be operated in various ways.

Additionally, with reference to FIG. 10, the second rotation member 264 may be shifted in the cross direction CD relative to the support member 268. The support member 268 may include a plurality of connection apertures 280 and the second rotation member 264 may comprise a plurality of connection apertures 282 for connecting the second rotation member 264 with the support member 268. The connection apertures 280 may be substantially rectangular or arcuate in shape. The second rotation member 264 may be connected with the support member 268 in various cross directional CD positions by shifting the connection apertures 282 of the second rotation member 264 in the cross direction CD relative to the connection apertures 280 of the support member 268. It is to be appreciated that the second rotation member 264 may be connected with the support member 268 in various ways, including bolts or pins, for example. In some exemplary configurations, the second rotation member 264 and the support member 268 may be integrally formed. That is, the second rotation member 264 and the support member 268 may be combined into one element. The support member 268 may be configured in various ways to shift the second rotation member 264 in the cross direction CD.

Figure 11:
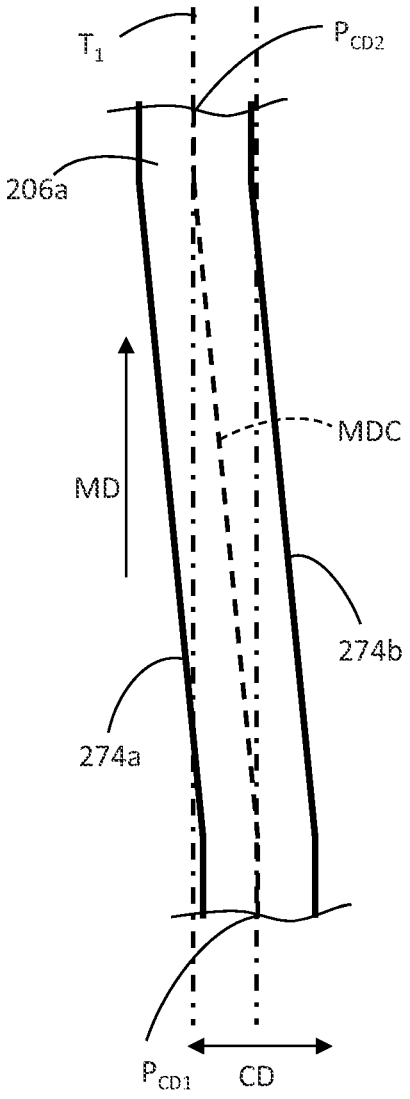
FIG. 11 is a schematic, plan view of a first web in the form of a first belt substrate.
Figure 12:
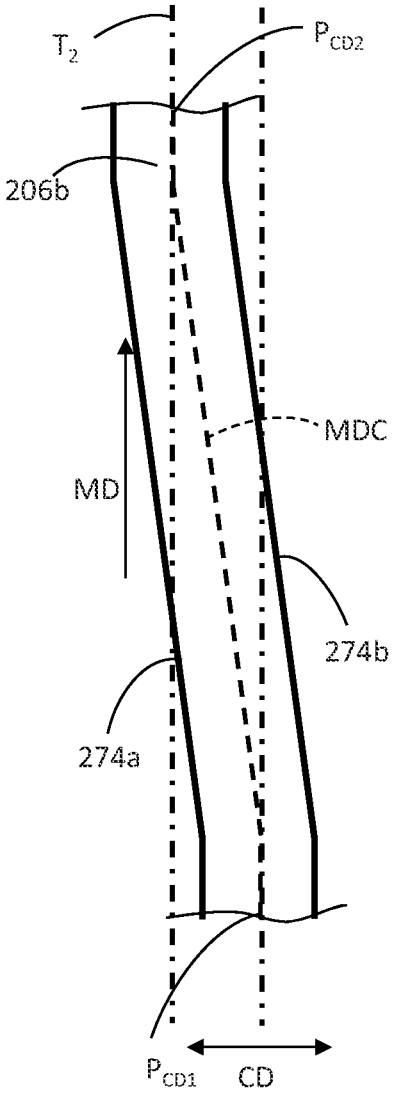
FIG. 12 is a schematic, plan view of a second web in the form of a first belt substrate.

As previously mentioned, with reference to FIGS. 9, 11, and 12, the web spacing device 212 may be used to space to cross-directionally shift two webs by different degrees. For example, to shift a first web, shown in FIG. 11 as first belt substrate 206*a* for exemplary purposes only, advancing in the machine direction MD, the web spacing device 212 may be positioned in a first configuration by rotating the frame 224 about the second axis of rotation 272 using the second rotation member 264. Then, the first web may advance in the machine direction MD onto the web spacing device 212 in the first configuration. The web spacing device 212 may shift the machine direction centerline MDC of the first web in the cross direction CD and align the machine direction centerline MDC of the first web with a first target cross-directional position $T_1$ while changing the actual cross-directional position of the first web from the first actual cross-directional position $P_{CD1}$ to the second actual cross-directional position $P_{CD2}$. Then, to shift a second web advancing in the machine direction MD, the web spacing device 212 may be positioned in a second configuration by rotating the frame 224 about the second axis of rotation 272 using the second rotation member 264. The second configuration is different from the first configuration. The second web, shown in FIG. 12 as first belt substrate 206*b* for exemplary purposes only, may advance in the machine direction MD onto the web spacing device 212. The web spacing device 212 may shift the machine direction centerline MDC of the second web in the cross direction CD and align the machine direction centerline MDC of the second web with a second target cross-directional position $T_2$, while changing the actual cross-directional position of the second web from the first actual cross-directional position $P_{CD1}$ to the second actual cross-directional position $P_{CD2}$. The second target cross-directional position $T_2$ is different from the first target cross-directional position $T_2$. That is, the web spacing device 212 may be configured to shift the second web in the cross direction CD by a greater degree than the web spacing device 212 shifts the first web in the cross direction CD.

Figure 13:
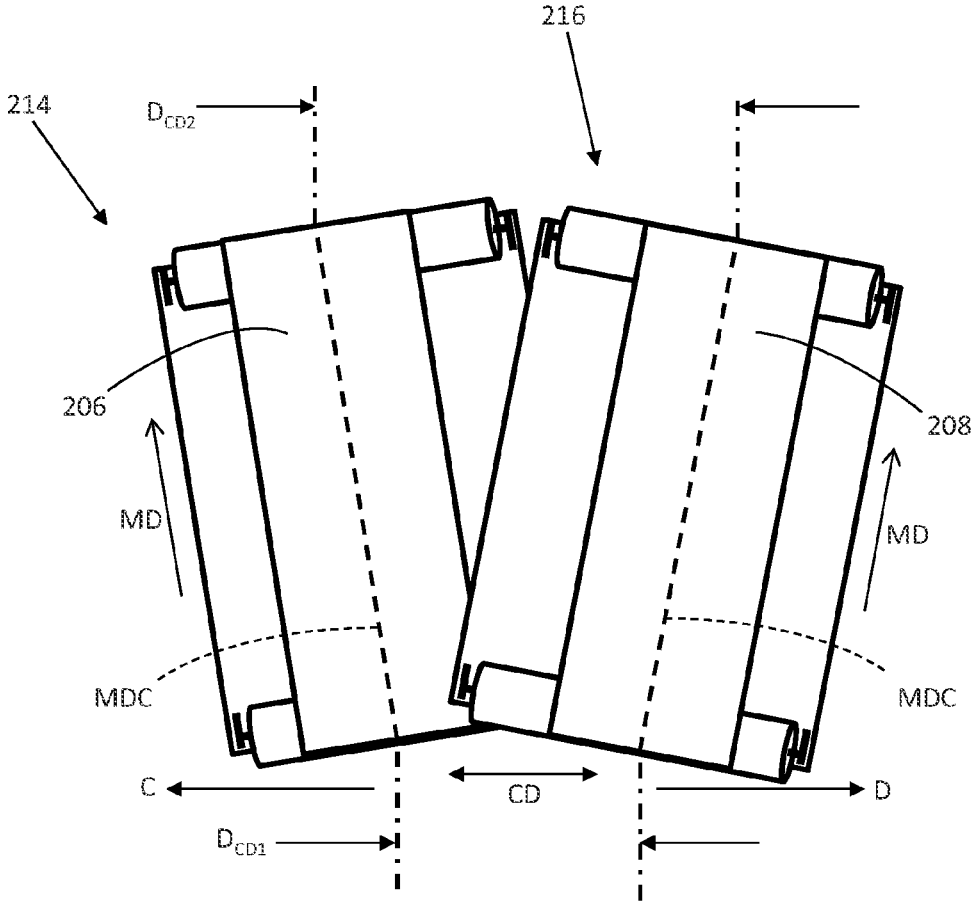
FIG. 13 is a schematic, back elevation view of first and second web spacing devices.

In some exemplary configurations, such as shown in FIG. 13, the converting apparatus of FIG. 4 may include a first web spacing device 214 and a second web spacing device 216. As shown in FIG. 13, the first and second web spacing devices 214, 216 may be configured to adjust the cross-directional CD distance between the machine direction centerline MDC of a first continuous belt substrate 206 and second continuous belt substrate 208 advancing in the machine direction MD from a first cross-directional distance $D_{CD1}$ to a second cross-directional distance $D_{CD2}$. In particular, with reference to FIGS. 13 and 14, the first web spacing device 214 may be configured to shift the cross-directional CD position of the machine direction centerline MDC of the first continuous belt substrate 206 in a first cross direction, such as directions C and E shown in FIGS. 13 and 14, and the second spacing device 216 may be configured to shift the cross-directional CD position of the machine direction centerline MDC of the second continuous belt substrate 208 in a second cross direction, such as directions D and F shown in FIGS. 13 and 14. The first directions C, E may be opposite the second cross directions D, F.

Figure 14:
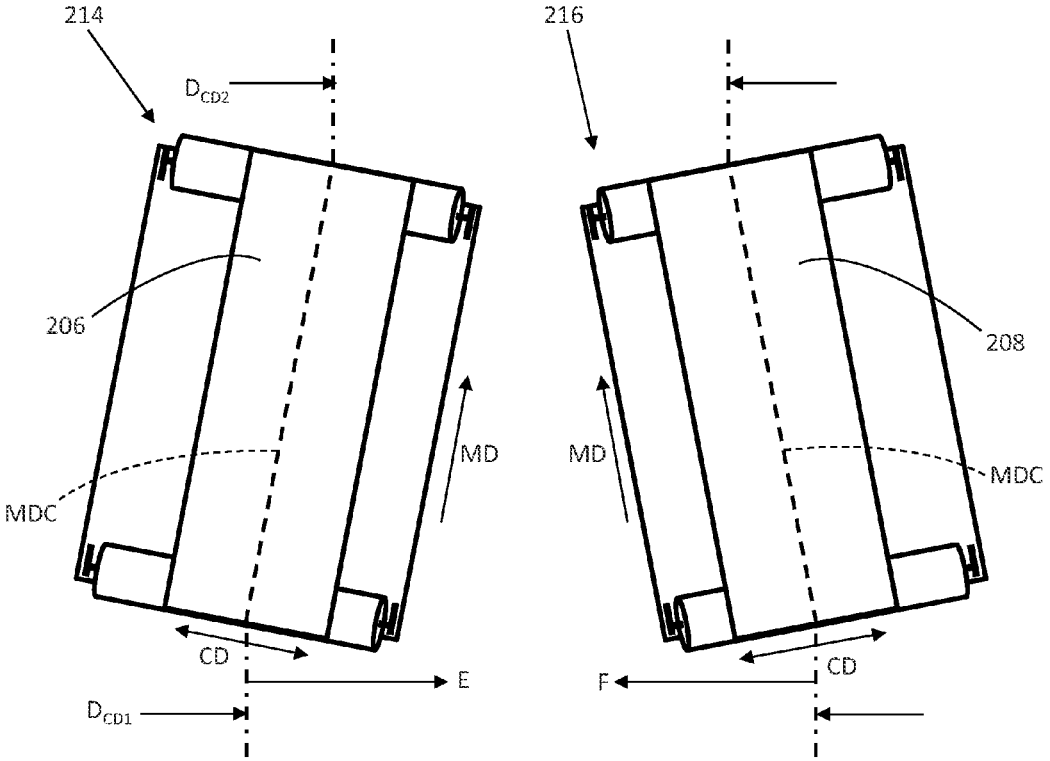
FIG. 14 is a schematic, back elevation view of first and second web spacing devices.
Figure 15:
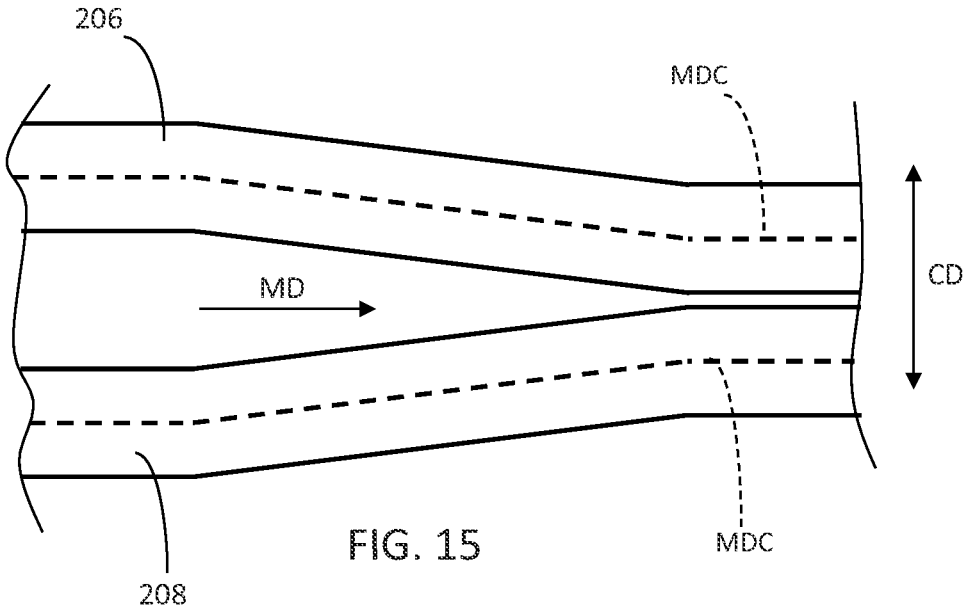
FIG. 15 is a schematic, plan view of first and second continuous belt substrates.

In some exemplary configurations, such as shown in FIG. 14, the first and second cross directions C, E and D, F may converge, while in other exemplary configurations, such as shown in FIG. 13, the first and second cross directions C, E and D, F may diverge. For example, with reference to FIGS. 4F and 13, the first and second web spacing devices 214, 216 may be used to separate the first and second belt substrates 206, 208 in the cross direction CD. In other exemplary configurations, such as shown in FIGS. 14 and 15, the first and second web spacing devices 214, 216 may be configured to bring the first and second belt substrates 206, 208 closer together in the cross direction CD. For manufacturing different size absorbent articles, the first and second web spacing devices 214, 216 may be configured to space the first and second belt substrates 206, 208 by various degrees. For example, the cross-directional distance between the machine direction centerlines MDC of the first and second belt substrates 206, 208 may increase as the size of the absorbent article increases.

Figure 16:
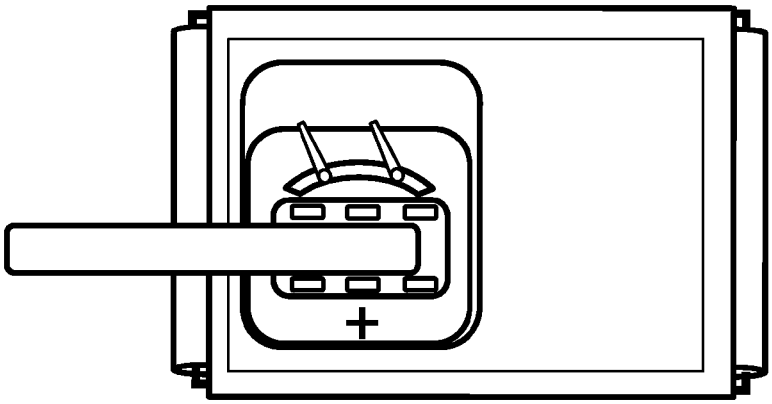
FIG. 16 is a schematic, front elevation view of a web spacing device in a substantially horizontal orientation.
Figure 17:
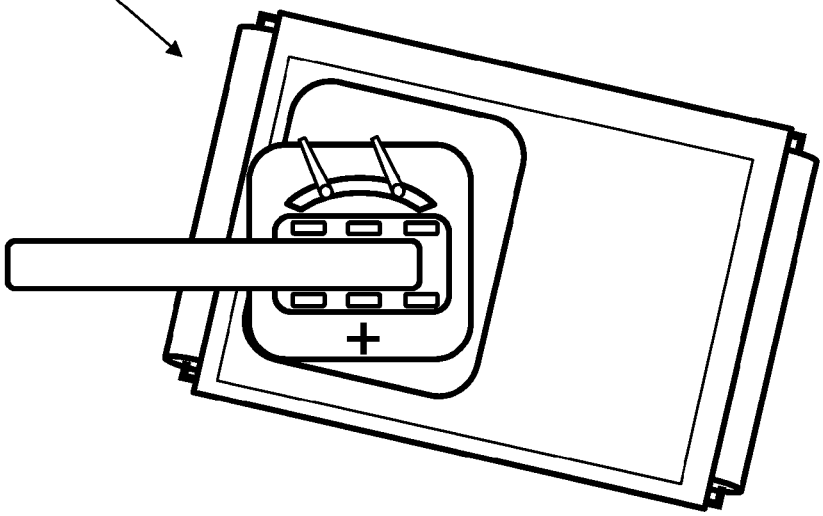
FIG. 17 is a schematic, front elevation view of a web spacing device.

While the web spacing device 212 or devices 214, 216 may be arranged in a substantially vertical orientation, such as shown in FIGS. 5A, 9, and 10, it is to be appreciated that the web spacing device 212 or devices of the present disclosure may be arranged in a substantially horizontal orientation, such as shown in FIGS. 16 and 17.

With reference back to FIG. 5A, the guide member 228 may be configured as first and second guide members 236, 238. As shown in FIG. 5A, each guide member 236, 238 may be in the form of an idler bar. The idler bars may be rotatable, or the idler bars may be stationary. It is to be appreciated that the guide member 228 may be configured in various ways. For example, each guide member 228 may be configured as an idler bar, roller, conveyor, or the like. In some exemplary configurations, the guide member 228 may have a single, unitary outer surface. For example, the guide member 228 may be configured as a conveyor or a series of conveyors having a unitary outer surface.

With reference to FIG. 5A, the frame 224 may be configured to join a first guide member 236 with a second guide member 238. However, it is to be appreciated that the frame 224 may be configured in various ways depending upon the configuration of the guide member 228 or guide members. Likewise, various motors may be used to rotate the frame 224 about the first axis of rotation 226. In addition, various sensors may be used to sense the cross-directional CD position of the machine direction centerline MDC of the advancing web. An exemplary frame, motor, and sensor are available from Erhardt+ Leimer under the designation Pivoting Frame, model DR 3111.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for controlling cross-directional movement of a web advancing in a machine direction, wherein the web defines a machine direction centerline, the apparatus comprising:

a frame having a first end portion and a second end portion separated by a central portion, wherein the frame is rotatable about a first axis of rotation;

a first rotation member movably connected with the frame, wherein the first rotation member is configured to rotate the frame by a first angle of rotation about the first axis of rotation; and a second rotation member movably connected with the frame, wherein the second rotation member is configured to rotate the frame about a second axis of rotation by a second angle of rotation, wherein the second angle of rotation is greater than the first angle of rotation, and wherein the second rotation member comprises a rotation aperture and a locking member, wherein the locking member is connected with the frame and extends through the rotation aperture.

2. The apparatus of claim 1 further comprising a first guide member connected with the first end portion of the frame and a second guide member connected with the second end portion of the frame, wherein the first and second guide members each have an outer surface.

3. The apparatus of claim 2, wherein the first and second guide members are idler bars.

4. The apparatus of claim 2, wherein the outer surface of the first guide member is configured to receive the advancing web, wherein the outer surface of the second guide member is configured to receive the web advancing from the outer surface of the first guide member.

5. The apparatus of claim 1, wherein the first rotation member comprises a motor, wherein the motor is configured to rotate the frame about the first axis of rotation to align the machine direction centerline of the advancing web with a target cross-directional position.

6. The apparatus of claim 5, wherein the second rotation member is configured to rotate the frame about the second axis of rotation to adjust the target cross-directional position from a first target cross-directional position to a second target cross-directional position that is different from the first target cross-directional position.

7. The apparatus of claim 1 further comprising an adaptor member that is configured to connect the frame with the second rotation member.

8. The apparatus of claim 1, wherein the first axis of rotation and the second axis of rotation are the same.

9. The apparatus of claim 1, wherein the first rotation member further comprises a sensor configured to detect the cross-directional position of the machine direction centerline of the web.

10. The apparatus of claim 1 further comprising a support member adjustably connected with the second rotation member, wherein the second rotation member is adjustably connectable with the support member in various cross-directional positions.

11. The apparatus of claim 1, wherein the second rotation member is configured to manually rotate the frame about the second axis of rotation.

12. The apparatus of claim 1 further comprising a first web spacing device and a second web spacing device, wherein each web spacing device comprises a frame rotatable about a first axis of rotation; a first rotation member movably connected with the frame and configured to rotate the frame by a first angle of rotation about the first axis of rotation; and a second rotation member movably connected with the frame and configured to rotate the frame by a second angle of rotation about a second axis of rotation, wherein the second angle of rotation is greater than the first angle of rotation, wherein the first web spacing device is configured to shift a first advancing web in a first cross direction and the second web spacing device is configured to shift a second advancing web in a second cross direction, wherein the first cross direction is opposite the second cross direction.

13. An apparatus for controlling cross-directional movement of a web advancing in a machine direction, wherein the web defines a machine direction centerline, the apparatus comprising:

a frame having a first end portion and a second end portion separated by a central portion, wherein the frame is rotatable about a first axis of rotation;

a first rotation member movably connected with the frame, wherein the first rotation member is configured to rotate the frame by a first angle of rotation about the first axis of rotation, and wherein the first rotation member is configured to align a machine direction centerline of an advancing web with a target cross-directional position; and a second rotation member movably connected with the frame, wherein the second rotation member is configured to rotate the frame about a second axis of rotation by a second angle of rotation, wherein the second angle of rotation is greater than the first angle of rotation, and wherein the second rotation member is configured to adjust the target cross-directional position from a first target cross-directional position to a second target cross-directional position that is different from the first target cross-directional position.

14. The method of claim 13, wherein the first rotation member comprises a motor, wherein the motor is configured to rotate the frame about the first axis of rotation.

15. The apparatus of claim 13, comprising a first web spacing device and a second web spacing device, wherein each web spacing device comprises a frame rotatable about a first axis of rotation; a first rotation member movably connected with the frame and configured to rotate the frame by a first angle of rotation about the first axis of rotation; and a second rotation member movably connected with the frame and configured to rotate the frame by a second angle of rotation about a second axis of rotation, wherein the second angle of rotation is greater than the first angle of rotation, wherein the first web spacing device is configured to shift a first advancing web in a first cross direction and the second web spacing device is configured to shift a second advancing web in a second cross direction, wherein the first cross direction is opposite the second cross direction.

16. The apparatus of claim 13, comprising an adaptor member that is configured to connect the frame with the second rotation member.

17. The apparatus of claim 13, wherein the first axis of rotation and the second axis of rotation are the same.

18. An apparatus for controlling cross-directional movement of a web advancing in a machine direction, wherein the web defines a machine direction centerline, the apparatus comprising:

a frame having a first end portion and a second end portion separated by a central portion, wherein the frame is rotatable about a first axis of rotation;

a first rotation member movably connected with the frame, wherein the first rotation member is configured to rotate the frame by a first angle of rotation about the first axis of rotation; and a second rotation member movably connected with the frame, wherein the second rotation member is configured to rotate the frame about a second axis of rotation by a second angle of rotation, wherein the second angle of rotation is greater than the first angle of rotation; and a first web spacing device and a second web spacing device, wherein each web spacing device comprises the frame, wherein the first web spacing device is configured to shift a first advancing web in a first cross direction and the second web spacing device is configured to shift a second advancing web in a second cross direction, wherein the first cross direction is opposite the second cross direction.

19. The apparatus of claim 18, wherein the first axis of rotation and the second axis of rotation are the same.

20. The method of claim 18, wherein the first rotation member comprises a motor, wherein the motor is configured to rotate the frame about the first axis of rotation.

* * * * *